United States Patent [19]

Kikumoto et al.

[11] Patent Number: 4,694,724

[45] Date of Patent: Sep. 22, 1987

[54] SYNCHRONIZING SIGNAL GENERATOR FOR MUSICAL INSTRUMENT

[75] Inventors: Tadao Kikumoto; Isato Murakami, both of Osaka, Japan

[73] Assignee: Roland Kabushiki Kaisha, Osaka, Japan

[21] Appl. No.: 747,555

[22] Filed: Jun. 21, 1985

[30] Foreign Application Priority Data

Jun. 22, 1984 [JP] Japan ..... 59-129745

[51] Int. Cl.[4] ..... G10H 1/42

[52] U.S. Cl. ..... 84/1.03; 84/1.28; 84/DIG. 29

[58] Field of Search ..... 84/1.03, 1.28, DIG. 29

[56] References Cited

U.S. PATENT DOCUMENTS

| | | | |
|---|---|---|---|
| 3,604,299 | 9/1971 | Englund | 84/1.03 |
| 3,781,452 | 12/1973 | Vauclain | 84/1.28 |
| 4,419,918 | 12/1983 | Dyck et al. | 84/1.03 |
| 4,566,362 | 1/1986 | Kikumoto | 84/1.03 |

*Primary Examiner*—S. J. Witkowski

*Attorney, Agent, or Firm*—Wenderoth, Lind & Ponack

[57] ABSTRACT

In a synchronized sound recording and reproducing system including a tape recorder to playback a tape carrying time code information indicative of particular longitudinal locations of the tape, a sequencer having sound information programmed therein and a manually operated tapping key to be tapped by an operator to produce heat signals, a synchronizing signal generator for providing synchronism between the base sounds reproduced from the tape and the additional sounds reproduced from the sound information memorized in the sequencer, comprising beat interval detecting means operative to detect, on the basis of the time code information from the tape, the time intervals between the successive beat signals produced by the beat signal generating means, and rhythm information generating means for generating rhythm information based on the pattern of the time intervals.

6 Claims, 11 Drawing Figures

SYNCHRONIZING SIGNAL GENERATOR FOR MUSICAL INSTRUMENT

FIELD OF THE INVENTION

The present invention relates generally to electronic musical instruments and particularly to an electronic sychronized sound recording and reproducing system. More particularly, the present invention is concerned with a synchronizing signal generator for use in such a sound recording and reproducing system.

BACKGROUND OF THE INVENTION

An electronic synchronized sound recording and reproducing system to which the present invention appertains includes a sound recording and reproducing apparatus a typical example of which is a sound tape recorder which reproduces sound information from a tape as a series of audible sounds such as, for example, a music which is herein referred to as base music. The tape recorder is provided in combination with a sequencer module in which sound information to be reproduced as a series of audible sounds, or an additional music, is preliminarily programmed. The tape recorder and the sequencer module are operated in synchronism with each other so that the base music recorded on the tape set on the tape recorder and the additional music memorized in the sequencer module are reproduced concurrently.

In an electronic synchronized sound recording and reproducing system of the described general nature, it is desirable that both of the base and additional musics be reproduced at tempos reflecting the operator's emotional expressions. It has for this purpose been proposed and put into practice to have external tempo information fed to the sequencer module in which the additional music is preliminarily memorized. An example of an electronic synchronized sound recording and reproducing system having such a capability is taught in Japanese Patent Application No. 56-23651.

In a system shown in this Patent Application, a synchronizing signal generator is connected between a tape recorder and a sequencer module and has a basic function to provide synchronism between the two series of sound information, or base and additional musics, to be reproduced by the tape recorder and the sequencer module, respectively, during playback mode of operation of the system. The system has an additional capability of memorizing beat signals produced by an operator who beats time with a tapping key while listening to the music being reproduced from the sound track of the tape on the tape recorder during write-in mode of operation of the system. These beat signals are fed to the tape recorder and are recorded on another record track, a beat track, of the tape as the beat information which represents the tempos expressed by the operator. During the write-in mode of operation, signals are also produced while are indicative of the time intervals between successive beat signals representing the series of beats. Thus, the number of the clock signals which intervene between any successive two beat signals is indicative of the time interval between two successive beats. These clock signals are memorized into an internal memory provided in the synchronizing signal generator.

During the playback mode of operation which follows such a write-in mode of operation, the tape recorder reads the beat signals from the beat track of the tape while reproducing the sound information from the sound track of the tape. The beat signals are converted into synchronizing signals each of which is transferred to the synchronizing signal generator from the tape recorder. The synchronizing signal generator accesses any one of the addresses of the internal memory therein each time the signal generator receives a synchronizing signal and thus reads the time intervals stored at the selected address of the memory. A total of twenty four MIDI (Musical Instrument Digital Interface) clock pulses are generated for each of these time intervals. To produce such MIDI clock pulses, the internal memory of the synchronizing signal generator in which the time intervals between the successive beat signals are memorized, during write-in mode of operation, in the form of the number of bits each having a time duration of 417 microseconds and the number of frames each consisting of eighty bits, in compliance with the SMPTE (Society of Motion Picture and Television Engineers) Standards. The time duration $T_i$ of an MIDI clock pulse is calculated, during playback mode of operation, on the basis of these numbers of frames and bits, or frame count ($X_i$) and bit count ($Y_i$), in accordance with the following formula:

$$T_i=(417*80*X_i+417*Y_i)/24 \quad (1)$$

The MIDI clock pulses thus generated are supplied in succession from the synchronizing signal generator to the sequencer module, which generates sound signals on the basis of the tempo information represented by this series of MIDI clock pulses and the sound information memorized in the sequencer module per se. These sound signals are fed to a subsequent synthesizer module and is synthesized into an additional music which is to be produced from a sound generator in synchronism with the base music reproduced from the tape in the tape recorder.

A known synchronized sound recording and reproducing system of the described nature has had a drawback which results from the fact that there are available no specific indications of those physical locations of the recording tape at which the individual beat signals occur on and along the code track of the tape. For this reason, the beat signals recorded on the tape can be detected from the tape not in terms of the physical locations on the tape but in terms of the sequence in which the successive beat signals occur along the tape. The synchronization between the beat signals read from the tape and the time intervals between the successive beat signals read from the internal memory of the system is normally achieved on the basis of a certain established time-axis correlation between the two kinds of time bases. It may however happen that such a time-axis correlation be lost or deranged for one cause or another as, typically, when a dropout of a beat signal takes place on the tape. When this occurs, the time base to dictate the tempo of the additional sound information to be synthesized through the sequencer module fails to match the time base to dictate the tempo of the sound information to be reproduced from the tape recorder. The synchronizing signal generator of a prior-art synchronized sound recording and reproducing system of the described nature could not recover the proper correlation between the aforesaid two kinds of time bases once such correlation is lost or deranged. Failure to recover the correlation would thus lead to a mismatch between the sound information being reproduced from the tape and the additional sound information being produced through the sequencer module.

On the other hand, the MIDI clock signals to provide the time base for the additional sound information to be synthesized through the sequencer module of a known synchronized sound recording and reproducing system of the described nature are generated on the basis of those time intervals between the successive beat signals which are read from the internal memory of the system and the clock pulses which are constantly produced at a rate inherent in the system. These time intervals memorized in the internal memory of the system are respectively identical with those between the successive beat signals which have been read from the tape being played back. If it happens that the tape is subjected to an excessive force and is as a consequence partially elongated during playback operation, the time intervals represented by the beat signals read from the elongated tape are no longer identical with those represented by the beat signals which have been read from the original tape. Also prolonged as a result of the elongation of the tape are the sound signals recorded on the elongated tape, the rate of prolongation of the sound signals being equal to the rate of prolongation of the time intervals between the beat signals on the elongated tape. The sound signals on the tape elongated should therefore be reproduced using a time base generated in accordance with the beat signals read from the elongated tape. The fact is however that the time base for use in the reproduction of the sound signals from the elongated tape is generated on the basis of the beat signals read from the tape which was not elongated, rather than from the beat signals read from the elongated tape. The MIDI clock pulses to provide the time base for the additional sound information to be synthesized through the sequencer module are generated depending on the time intervals between the successive beat signals as well as the system clock pulses. Thus, a mismatch in time is invited between the sound information being read from the tape and the additional sound information being produced by the sequencer module.

The user of a synchronized sound recording and reproducing system may wish to start the playback of a tape in a partially wound condition, such a mode of operation being herein referred to as intervening-playback mode of operation. In this intervening-playback mode of operation, the time intervals between the beat signals being successively reproduced from the recording tape could not be correlated with the time intervals between the beat signals being successively read from the internal memory of the system. In other words, the sum of the values corresponding to the time intervals read out in succession from the internal memory of the system could not represent the actual physical locations on the tape which is being played back. This means that the synchronized operation between the tape recorder and the sequencer module practically can not be performed in the intervening-playback mode.

There may also be a case where the user of the system wishes to playback a recorded piece of sound information at a tempo expressed by himself. For this purpose, the user, or operator, of the system taps on the tapping switch while listening to the sound information being reproduced by the tape recorder. The tempo thus expressed by the operator in the form of the beats produced at the tapping switch is recorded as the beat signals on the tape, while the time intervals between the beat signals being produced in succession are stored in the internal memory of the system. The operator may further wish to start the sequencer module a desired period of time before the tape recorder is to be started for playback operation. This mode of operation is herein referred to as preliminary solo mode of operation. Such a preliminary solo mode of operation is however inoperable in a prior-art synchronized sound recording and reproducing system of the described nature. This is because of the fact that the beat signals are not reproduced from the tape until the tape recorder is started. In spite, furthermore, of the fact that the sequencer module is enabled to operate only in the presence of MIDI clock pulses which are produced on the basis of the time intervals between the successive beat signals from the tape recorder.

It is accordingly a first prime object of the present invention to provide an improved synchronized sound recording and reproducing system which is substantially free from an occurrence of a mismatch which would otherwise be invited between the sound information reproduced from the tape recorder and the additional sound information synthesized through the sequencer module if the accumulative values of the time intervals provided by the internal memory of the system were not representative of actual physical locations of the recording tape being played back.

It is another object of the present invention to provide an improved synchronized sound recording and reproducing system in which synchronism between the sound information from the tape recorder and the additional sound information from the sequencer module is maintained throughout operation of the system although the time-axis correlation between the time intervals read from the recording tape and those successively read from an internal memory incorporated in the system might be temporarily or momentarily lost or disturbed due to, for example, a dropout of a beat signal in the memory.

It is still another object of the present invention to provide an improved synchronized sound recording and reproducing system in which the beat signals recorded on the recording tape are detected from the tape in terms of the physical locations on the tape rather than in terms of the sequence in which the successive beat signals occur along the recording tape.

Yet, it is a second prime object of the present invention to provide an improved synchronized sound recording and reproducing system which is substantially free from an occurrence of a mismatch which would otherwise be invited between the sound information reproduced from the tape recorder and the additional sound information synthesized through the sequencer module if the recording tape happens to be partially elongated during playback of the tape.

It is still another object of the present invention to provide an improved synchronized sound recording and reproducing system in which sound signals are reproduced from the recording tape using a time base generator on the basis of time codes indicative of physical locations on the tape which is being played back, rather than the beat interval codes stored into the internal memory of the system before the playback operation with the particular tape was started.

Yet, it is a third prime object of the present invention to provide an improved synchronized sound recording and reproducing system which will permit the user of the system to start the playback of a recording tape in a partially wound condition, viz., in an intervening-playback mode of operation as herein so referred to.

It is still another object of the present invention to provide an improved synchronized sound recording and reproducing system in which reproduction of sound information by the tape recorder is started in synchronism with the sequencer module on the basis of the time codes indicative of physical locations on the tape which is in a partially wound condition, rather than the beat interval codes read from the internal memory of the system.

Yet, it is a fourth prime object of the present invention to provide an improved synchronized sound recording and reproducing system which is operable in a preliminary solo mode of operation as herein so referred to, starting the sequencer module a desired period of time before the tape recorder is to be started for playback operation.

It is still another object of the present invention to provide an improved synchronized sound recording and reproducing system in which reproduction of sound information through the sequencer module can be started prior to the start of the tape recorder on the basis of the time codes representing the first beat interval between the beat signals to be thereafter reproduced.

SUMMARY OF THE INVENTION

In accordance with the present invention, there is provided a synchronizing sound recording and reproducing system including (a) sound information recording and reproducing means for recording base sound information and time code information on recording medium and reproducing the base sound information therefrom, the recording medium being movable with respect to the sound information recording and reproducing means the time code information being representative of different physical locations on the recording medium, the locations being arranged in the direction of movement of the recording medium, the sound information recording and reproducing means being operative to reproduce the time code information substantially in synchronism with the base sound information, (b) base sound generating means for generating base sounds on the basis of the base sound information reproduced by the sound information recording and reproducing means, (c) beat signal generating means for generating a beat signal each time the beat signal generating means is actuated, (d) synthesized-sound signal generating means operative to store additional sound information memorized therein and reproduce the stored additional sound information in accordance with a time base expressed by synchronizing signals providing tempo information, and (e) additional-sound synthesizing means for synthesizing and generating additional sounds on the basis of the additional sound information reproduced by the synthesized-sound signal generating means, comprising in combination (A) beat interval determining means for determining beat intervals on the basis of the time code information reproduced by the sound information recording and reproducing means and the beat signals generated by the beat signal generating means, (B) beat interval memorizing means for storing values respectively representative of the beat intervals determined by the beat interval determining means and allowing the stored values to be successively read out therefrom when required, (C) playback start location determining means for determining a particular physical location on the recording medium as the location at which playback operation is to be started by the sound information recording and reproducing means, the particular physical location corresponding to the first one of the beat signals produced by the beat signal generating means, the playback start location determining means determining the particular physical location in response to the first one of the beat signals and to the time code information reproduced by the sound information recording and reproducing means, (D) playback start location memorizing means for memorizing a value representative of the aforesaid particular physical location of the recording medium, (E) synchronized playback start time determining means for determining the point of time at which synchronized playback operation is to be started by the sound information recording and reproducing means and the additional-sound synthesizing means, the synchronized playback start time determining means determining the aforesaid point of time when a value representative of a physical location on the recording medium indicated by the time code information reproduced by the sound information recording and reproducing means is substantially equalized with a value representative of the aforesaid particular physical location memorized by the playback start location memorizing means, and (F) tempo information generating means which is to become active at the aforesaid point of time for generating tempo information on the basis of the values successively read out from the beat interval memorizing means and supplying the tempo information as synchronizing signals to the synthesized-sound signal generating means to enable the synthesized-sound signal generating means to reproduce the additional sound information and the additional-sound synthesizing means to generate the additional sounds in synchronism with the base sounds generated by said base sound generating means.

BRIEF DESCRIPTION OF THE DRAWINGS

The features and advantages of a synchronizing signal generator which forms part of a synchronized sound recording and reproducing system according to the present invention will be more clearly appreciated from the following description taken in conjunction with the accompanying drawings in which.

DESCRIPTION OF THE PREFERRED EMBODIMENT

Construction of the Embodiment

Figure 1:
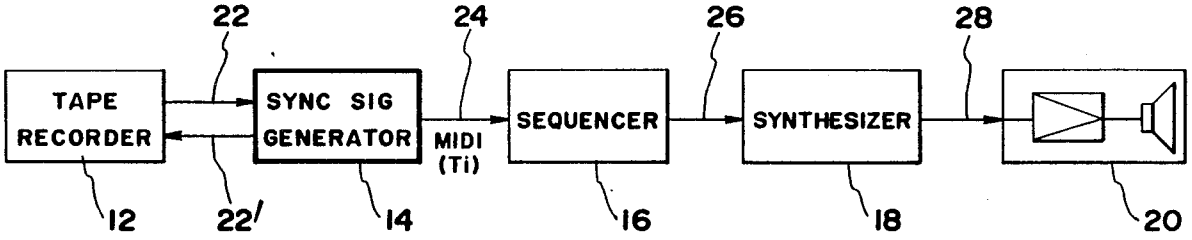
FIG. 1 is a block diagram showing the general construction of an electronic synchronized sound reproduction system recording and reproducing system including the synchronizing signal generator which forms part of a synchronized sound recording and reproducing system embodying the present invention.

Referring to FIG. 1 of the drawings, the synchronizing signal generator which forms part of a synchronized sound recording and reproducing system embodying the present invention comprises an audio tape recorder 12, a synchronizing signal generator 14, a sequencer module 16, a synthesizer module 18 and a sound generator unit 20. The tape recorder 12 represents a sound recording and reproducing apparatus in general and may be substituted by an audio disc player (not shown) where desired. The tape recorder 12 thus forming part of the system embodying the present invention is assumed to have capabilities such as, for example, fast-forward drive and rewind functions in addition to the usual sound recording and reproducing capabilities. The tape to be used on the tape recorder 12 of the system embodying the present invention is of the multitrack type having a plurality of parallel record tracks extending lengthwise of the tape. These record tracks include a record track (hereinafter referred to as sound track) used for the recording of sound information typically representative of a piece or pieces of sound information (herein referred to as base sound information) and a record track (hereinafter referred to as code track) used for the recording of time or tempo data expressed in the form of standardized time codes. In the embodiment herein shown, the format of such standardized time codes is assumed to be the one that complies with the SMPTE Standards as will be described in more detail.

The tape recorder 12 is connected to the synchronizing signal generator 14 via two signal lines consisting of a first signal line 22 leading from the former to the latter and a second signal line 22' leading from the latter to the former. The synchronizing signal generator 14 has incorporated therein an internal memory, into which are stored tempo data representative of a tempo expressed by an operator who taps on the tapping key (not shown) which forms part of the system embodying the present invention. More specifically, the tempo data memorized in the internal memory of the synchronizing signal generator 14 are provided in the form of beat interval codes representative of the intervals between the successive beats generated by the operator. Such intervals are herein referred to as time intervals or beat intervals. The beat interval codes are generated and memorized into the internal memory of the synchronizing signal generator 14 during write-in mode of operation of the system, as will be described in more detail.

During playback mode of operation of the system, the synchronizing signal generator 14 is operative to produce synchronizing signals as the tempo information which is typically in the form of MIDI clock pulses representative of the operator's expressed tempo as specified on the basis of the SMPTE time code signals read out in digitized form from the code track of the tape during write-in mode of operation of the system. These MIDI clock pulses are fed to the sequencer module 16 over a signal line 24. The sequencer module 16 has also incorporated therein an internal memory which is to memorize information (hereinafter referred to as additional sound information) desired to be reproduced in addition to and synchronized with the base music to be reproduced from the tape. Such additional sound information is stored in coded form within the sequencer module 16 preliminarily by the operator himself or any other person. In response to the MIDI clock pulses supplied for synchronization from the synchronizing signal generator 14 as discussed above, the sequencer module 16 delivers signals representing the additional sound information in accordance with a time base expressed by governed by the MIDI clock pulses. The output signals from the sequencer module 16 are supplied via a signal line 26 to the synthesizer module 18 and enable the synthesizer module 18 to synthesize the additional sound information through the sound generator unit 20 (shown connected to the synthesizer module 18 by a line 28) keeping time with the base sound information being reproduced by the tape recorder 12. The sound generator unit 20 is provided independently of the sound generator incorporated in the tape recorder 12. The construction and operation of each of the sequencer module 16, synthesizer module 18 and sound generator unit 20 is well known in the art and will not be herein described.

During write-in mode of operation, the tape recorder 12 operates in a playback mode and reproduces the base sound information preliminarily recorded on the tape and the operator beats time on the tapping key while listening to the sound information being reproduced by the tape recorder 12. During this write-in mode of operation, furthermore, the SMPTE time code signals recorded on the code track of the tape are reproduced by the tape recorder 12 to be transferred through the first signal line 22 to the synchronizing signal generator 14. A series of SMPTE time code frames expressed in the form of digital signals are extracted from these time code signals by means of the synchronizing signal generator 14, which thus first memorizes the codes in the initial, viz., starting frame of the time codes in one of the internal registers also included in the synchronizing signal generator 14 as will also be described in more detail. The content of this internal register is updated as the tape travels past the playback head of the tape recorder 12 by adding the clock pulses of the time code to the starting frame read out at the beginning of the tape so that the successive frames of the SMPTE time codes are memorized one after another in the internal register. While the content of the internal register of the synchronizing signal generator 14 is being thus updated periodically, a series of recurrent beat signals are generated by operator's tapping actions and are applied to the synchronizing signal generator 14 one at each of the time intervals which form the operator's expressed tempo. Each time a beat signal is applied to the synchronizing signal generator 14, there is provided a beat interval code which is expressed by the increment in the content of the internal register since the corresponding beat signal was received is expressed in the form of the number of time code frames and the number of bits short of a single frame. In this instance, each of the code frames consists of 80 bits and each of the bits has the time duration of 417 microseconds in compliance with the SMPTE Standards. The pieces of information thus expressed by these numbers of frames and bits are stored in the internal memory of the synchronizing signal generator 14 in conjunction with the immediately preceding beat signal received by the synchronizing signal generator 14. The number of time code frames and the number of bits thus counted to provide the beat interval code in the synchronizing signal generator 14 will be hereinafter referred to as frame count and bit count, respectively.

Figure 2:
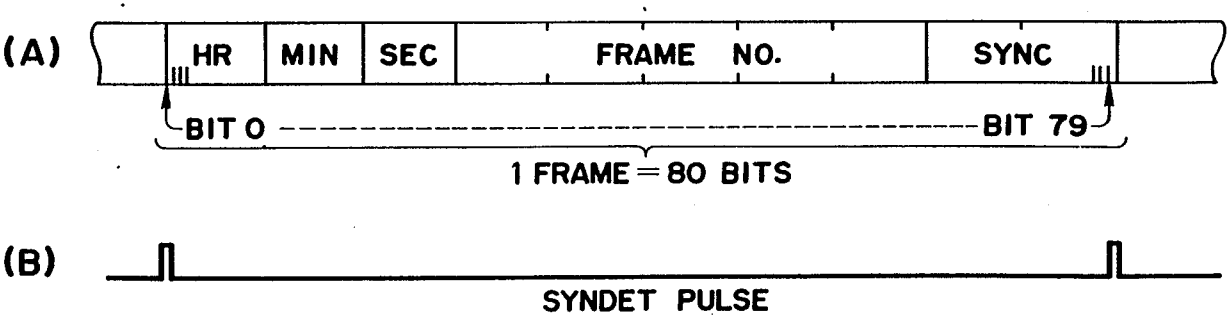
FIG. 2 is a view showing (A) the format of a frame of the SMPTE time code and (B) a waveform of the SYNDET synchronizing pulse as utilized in the synchronzing signal generator which forms part of a synchronized sound recording and reproducing system embodying the present invention.

The format of the SMPTE time codes used in the system embodying the present invention is shown in section (A) of FIG. 2. The SMPTE time codes are formulated in the form of a series of unit lengths or frames reccurring along the code track of the tape and each consisting of a total of 10 bytes. Each of these code frames contains three code sections indicative of the time in terms of, hour, minute and second, respectively, arranged in this sequence from the beginning of the code track of the tape and a frame-number code section indicative of the serial number assigned to the particular code frame. One byte is assigned to each of the hour, minute and second code sections and five bytes assigned to the frame-number code section. The remaining two bytes of each code frame are assigned to a code section to indicate a synchronizing word (SYNDET) on the basis of which a synchronizing pulse SYNDET is to be produced at the end of the frame as shown in section (B) of FIG. 2. The individual frames of the SMPTE time codes thus formulated are memorized in the internal memory of the synchronizing signal generator 14 respectively at addresses designated by and corresponding to the beat signals applied to the synchronizing signal generator 14. Thus, the beat interval codes representative of the time intervals between successive two beats stored in the synchronizing signal generator 14 as tempo data are respectively specified by the successive code frames and the bits appearing during the intervals between successive two beats and, accordingly, by different physical locations on the tape in the direction of travel of the tape.

During playback mode of operation of the system, the tape recorder 12 also operates in a playback mode reproducing the base sound information from the tape. Concurrently as the sound information is being thus reproduced by the tape recorder 12, the tempo data memorized in the internal memory of the synchronizing signal generator 14 during the write-in mode are read therefrom and a series of timing signals or MIDI clock pulses are produced by the synchronizing signal generator 14 on the basis of these tempo data. The individual longitudinal locations of the tape being now respectively in correspondence with the timings of the beats represented by the tempo data memorized in the synchronizing signal generator 14 as explained above, the synchronizing signal generator 14 is enabled to read the tempo data precisely keeping time with the tempo with which the base sound information is being reproduced by the tape recorder 12. In the embodiment of the present invention, the timing signals or MIDI clock pulses thus produced by the synchronizing signal generator 14 on the basis of the tempo data stored therein are formulated in compliance with MIDI Standards. In accordance with the MIDI Standards, one quarter note corresponds to four MIDI beats each of which consists of six MIDI clock pulses so that every twenty four of such clock pulses corresponds to a quarter note. The time duration $T_i$ of each of such an MIDI clock pulse is given by the formula:

$$T_i=(Tc*X_i+Tc/80Y_i)/24, \quad (2)$$

where $T_c$ represents the length of time in microsecond actually spent for the reproduction of each frame of the SMPTE time codes and corresponds to the time interval between the SYNDET synchronizing pulses (section (B) of FIG. 2) in successive two SMPTE code frames., $X_i$ the frame count, viz., the number of the time code frames which intervene between the occurrences of successive two beats, and $Y_i$ the bit count, viz., the total number of the bits which are short of one complete frame consisting of a total of 80 bits. The time length $T_c$ is measured in the course of playback operation by means of a time counter also incorporated in the synchronizing signal generator 14.

During playback mode of operation, the synchronizing signal generator 14 thus modifies the time durations $T_i$ of the MIDI clock pulses on the basis of the tempo data memorized in the internal memory of the synchronizing signal generator 14. The time base for the reproduction of the additional sound information memorized in the internal memory of the sequencer module is thus adjusted so that the additional sound information can be reproduced at a tempo exactly reflecting the subtle "glide" of the tempo expressed by the beat signals which have been produced by the operator's tapping action. The additional sound information memorized in the sequencer module 16 can be in this fashion reproduced with natural or orderly tempos strictly in synchronism with the base sound information being reproduced by the tape recorder 12 even if the tape in use on the tape recorder 12 may have been appreciably elongated or longitudinally shrunk from its initial length.

There may be a case where it is desired that the additional sound information memorized in the sequencer module 16 be reproduced concurrently with the base sound information reproduced from the tape which has been rewound midway. Such a mode of operation of the system according to the present invention is herein referred to as intervening-playback mode of operation. During this intervening-playback mode of operation, the tape recorder 12 operates also in a playback mode and one SMPTE time code frame is first read from the time code information reproduced from the partially rewound tape and is memorized into the previously mentioned internal register of the synchronizing signal generator 14. Thereupon, the bits forming the subsequent time code frames are counted and the result of the counting is added (in another register) to the current content of the internal register as the bits occur one after another. It will be understood that the resultant sum corresponds to a particular lengthwise location of the tape in the tape recorder 12. On the other hand, the beat interval codes expressed by the number of frames and the number of bits in the SMPTE time codes as memorized into the internal memory of the synchronizing signal generator 14 during the preceding write-in mode of operation are read fast from the addresses beginning with the address at which the starting beat interval code is memorized. The SMPTE time codes read from the individual addresses thus accessed or, more particularly, the frame counts and the bit counts read from the addresses which have been accessed stepwise are added up successively until the resultant sums of the frames and bits are respectively equalized with and then exceed by "1" value the frame number and bit number indicated by the current content of the internal register. At the point of time the contents of the frame-count and bit-count sections of the internal register which is being continually increased is thereafter equalized with the sums of the frames and bits, the synchronizing signal generator 14 determines the time durations $T_i$ of the MIDI clock pulses in accordance with the formula (2). The MIDI clock pulses are supplied to the sequencer module 16 for reproduction of the additional sound information in synchronism with the base sound information reproduced by the tape recorder 12 as in the normal playback mode of operation.

There may also be a case where it is desired that reproduction of the additional sound information by the sequencer module 16 be started prior to the start of reproduction of the base sound information by the tape recorder 12. This mode of operation may be performed where the tape to be played back has a blank area (which is devoid of sound information) preceding the sound information recorded thereon. Such a mode of operation of the system according to the present invention is herein referred to as preliminary solo mode of operation as previously defined. Prior to this preliminary solo mode of operation, a signal representative of a desired number of the beats for the additional sound information alone to be reproduced by the sequencer module 16 is loaded into the synchronizing signal generator 14 by the operator. The synchronizing signal generator 14 then accesses the starting address of the internal memory thereof and reads from this particular address the frame and bit counts between the first and second beats to determine the beat intervals for use in a preliminary solo mode of operation. The time duration $T_i$ of the MIDI clock pulse is then determined by the synchronizing signal generator 14 on the basis of the frame and bit counts thus read from the internal memory. The MIDI clock pulses with such a time duration are produced by a number which is proportional to the number of the beats assigned to the preliminary solo mode operation. The MIDI clock pulses thus produced are supplied to the sequencer module 16 for reproduction of the additional sound information alone until the tape recorder 12 starts reproduction of the base sound information in concert with the additional sound information.

Figure 3:
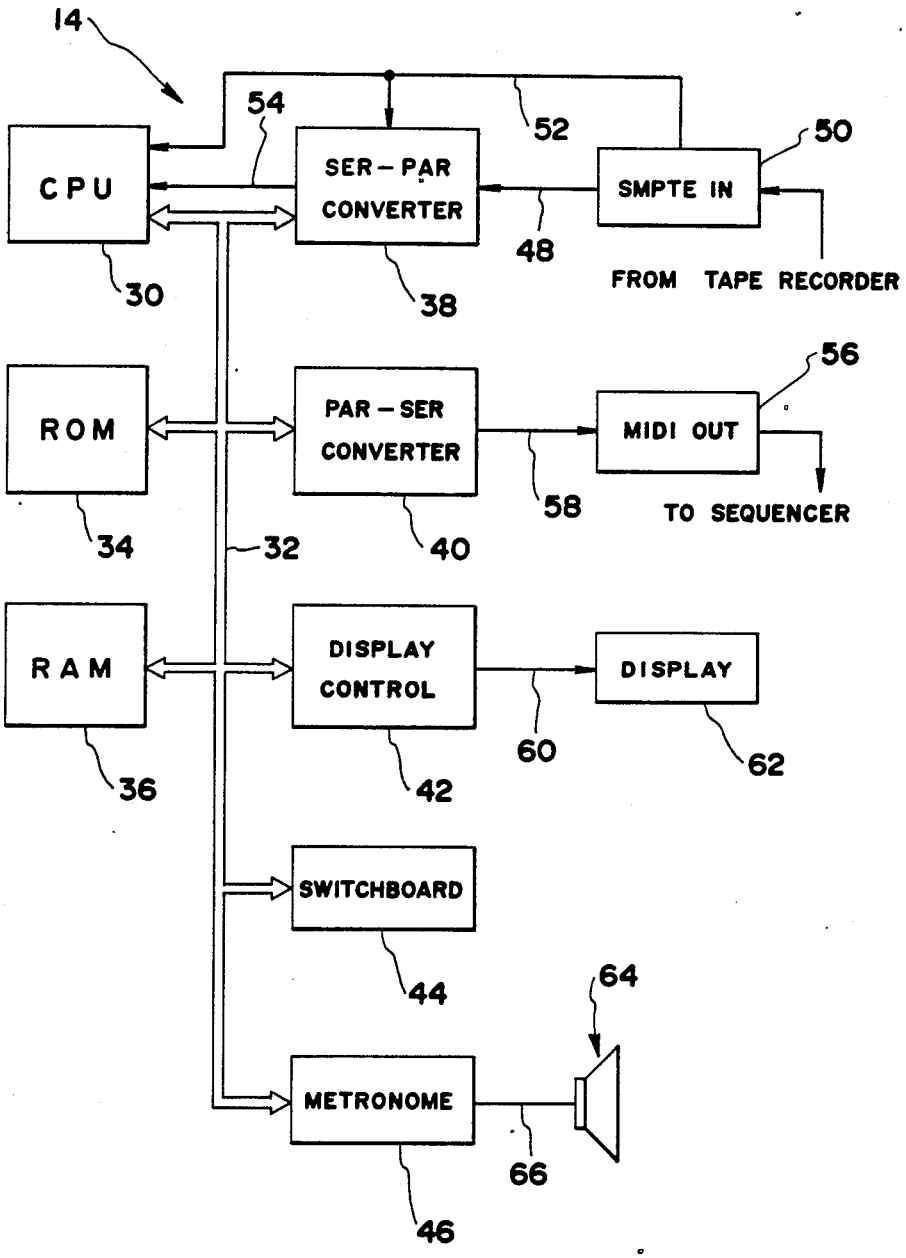
FIG. 3 is a block diagram showing the construction of a central processing unit 30 which forms part of the synchronizing signal generator which forms part of a synchronized sound recording and reproducing system embodying the present invention.

FIG. 3 of the drawings shows a preferred example of the general construction of the synchronizing signal generator 14 which is operative as hereinbefore described. As shown, the synchronizing signal generator 14 comprises a central processing unit (hereinafter referred to as CPU) 30 which is connected through a common data bus 32 to a read-only memory (hereinafter referred to as ROM) 34, a random-access memory (hereinafter referred to as RAM) 36, a serial-to-parallel converter converter 38, a parallel-to-serial converter converter 40, a display controller 42, a switchboard 44, and an adjustable metronome module 46. The ROM 34 has stored therein a variety of program instructions and, when requested by the central processing unit 30, supplies any of the program instructions to the central processing unit 30. The RAM 36 constitutes or at least forms part of the previously mentioned internal memory of the synchronizing signal generator 14 shown in FIG. 1 and provides various functions of the synchronizing signal generator 14 in cooperation with the ROM 34. The configuration of the RAM 36 will be later described in detail.

The serial-to-parallel converter 38 has an input terminal connected through a data line 48 to a SMPTE time-code signal input circuit 50 (labelled as "SMPTE IN") and parallel output terminals connected through a first interrupt line 54 to the central processing unit 30 along with the data bus 32 as shown. The SMPTE time-code signal input circuit 50 has parallel output terminals connected through a second interrupt line 52 to the central processing unit 30 and to the serial-to-parallel converter 38. The parallel-to-serial converter 40 has parallel input terminals connected to the common data bus 32 and an output terminal connected to a MIDI clock pulse output circuit 56 (labelled as "MIDI OUT") through a line 58. The display controller 42 has an output terminal connected through a line 60 to a display unit 62.

The SMPTE time-code signal input circuit 50 is connected by the signal line 22 (FIG. 1) to the tape recorder 12 and receives through the line 22 a frequency shifted time code signal produced by the tape recorder 12. The SMPTE time-code signal input circuit 50 has functions to discriminate and re-shape the waveform (which may be an FSK waveform) of the input signal to decode the signal into frames of SMPTE time codes in the form of digital codes during playback mode of operation. The SMPTE time code signals output from the SMPTE time-code signal input circuit 50 are to the serial-to-parallel converter 38 through the data line 48 and enables the serial-to-parallel converter 38 to produce an interrupt signal in response to an SYNDET synchronizing pulse which appears at the end of each of the SMPTE time code frames supplied from the SMPTE time-code signal input circuit 50. This interrupt signal is fed to the central processing unit 30 via the first interrupt line 54 and enables the central processing unit 30 to generate a first interruption therein. The central processing unit 30 then reads, under the control of a program instruction issued from the ROM 36, the status indicating that an eight-bit serial-parallel conversion step is complete in the serial-to-parallel converter 38 and thus provides a read instruction to the serial-to-parallel converter 38. This is performed when, and only when, the tape is initiated to start. Each time an eight-bit serial-to-parallel conversion step is complete in the serial-to-parallel converter 38, the central processing unit 30 reads an assembly of the parallel eight bits from the serial-to-parallel converter 38 by way of the data bus 32. Each of the SMPTE time code frames loaded into the serial-to-parallel converter 38 is thus transferred to the central processing unit 30 by way of the common data bus 32 in synchronism with the 8 bit serial-to-parallel conversion rate. On the other hand, the SMPTE time-code signal input circuit 50 produces an interrupt signal in response to each of the bits forming the SMPTE time codes discriminated in response to the incoming frequency shifted signal and supplies the interrupt signal to the central processing unit 30 by way of the second interrupt line 52 to produce a second interruption therein. On the other hand, the parallel-to-serial converter 40 is adapted to produce the previously mentioned MIDI clock pulses representative of the tempo in the additional sound information to be reproduced by the sequencer module 16 (FIG. 1) as discussed previously. The MIDI clock pulses are produced in accordance with the previously presented formula (2) on the basis of the data supplied from the central processing unit 30 through the bus 32 and are supplied to the sequencer module 16 via the line 58 and by way of the MIDI clock pulse output circuit 56.

The display controller 42 is operative to scan the display unit 62 in response to digit information supplied from the central processing unit 30 via the common data bus 32 and to control the display unit 62 to provide visual indication of a decoded version of the digit information. The digit information to be displayed on the display unit 62 may include the frame number and the time in hour, minute and second indicated by the SMPTE time code frame which is currently memorized in the previously mentioned internal register of the synchronizing signal generator 14. The display unit 62 is constituted typically by an electroluminescent display tube which is capable of displaying a series of digits on its screen.

On the other hand, the switchboard 44 includes various keys and switches to be manipulated by the operator. These keys and switches are herein assumed, by way of example, to include a set of "ten" keys for loading numerals 0 to 9 into the system, a set of mode selection keys to select desired modes of operation available on the system, and the tapping key to be manipulated by the operator to beat time for the additional sound information. This tapping key implements beat signal generating means 45 in the system embodying the present invention. The modes of operation available on the system include a write-in mode of operation, a playback mode of operation, an intervening-playback mode of operation, and a preliminary-solo mode of operation. The keys and switches provided on the switchboard 44 may further include an initial time change switch, a frame/bit count memory change switch, a preliminary solo mode request switch, and a tapping-complete switch. The initial time change switch is to be manipulated when the intervening-playback mode of operation is selected by the operator. This switch is used to allow the operator to request the system to change the initial time memorized in the synchronizing signal generator 14. The numbers to indicate the desired new initial time can be loaded into the system with use of the "ten" keys on the switchboard 44. The frame/bit count memory change switch is used for permitting the operator to change the frame count and/or bit count memorized at any address of the internal memory of the synchronizing signal generator 14 and to thereby modify, at least partially, the tempo which has already been loaded into the internal memory of the synchronizing signal generator 14. The alternative number or numbers of the frame count and/or bit count to be memorized into the internal memory can be loaded also with use of the "ten" keys on the switchboard 44. The preliminary solo mode request switch is manipulated when the preliminary solo mode of operation is selected by the operator and is used to allow the operator to request the system to accept the operator's desired number of beats prior to the start of reproduction of the base sound information from the tape. The desired number of beats can also be loaded into the system with use of the ten keys. The tapping-complete switch is used to produce a tapping complete signal to inform the system that the operator's tapping actions are complete. The respective states of all these keys and switches on the switchboard 44 are periodically monitored by the central processing unit 30 and, in response to the loading of information from any of the keys and switches, accesses the ROM 34 for reading the program instruction to execute the required task.

The metronome module 46 has an output terminal connected to a sound generator 64 through a line 66 and may be put to use when an operator loads a new piece of additional sound information into the sequencer module 16. In such an instance, the metromone module 46 produces beat sounds from the sound generator 64 in synchronism with the MIDI clock pulses supplied from the MIDI clock pulse output circuit 56 of the synchronizing signal generator 14 while the operator is playing the music on, for example, a keyboard connected to the sequencer module 16 to have additional sound information loaded into the module 16. The sound generator 64 is provided independently of both of the sound generator unit 20 and the sound generator unit of the tape recorder 12 shown in FIG. 1.

The synchronizing signal generator 14 shown in FIG. 3 further comprises control buses and an address bus leading from the central processing unit 30 to the ROM 34 and RAM 36. These address and control buses are not shown in FIG. 3 but the connections of all of the address and control buses as well as the common data bus 32 and the interrupt lines 52 and 54 included in the arrangement shown in FIG. 3 will be apparent to those skilled in the art. Furthermore, the major functions of the central processing unit 30 shown in FIG. 3 will be clearly understood from the block diagram of FIG. 4 which shows the functional arrangement of the central processing unit 30.

Figure 5:
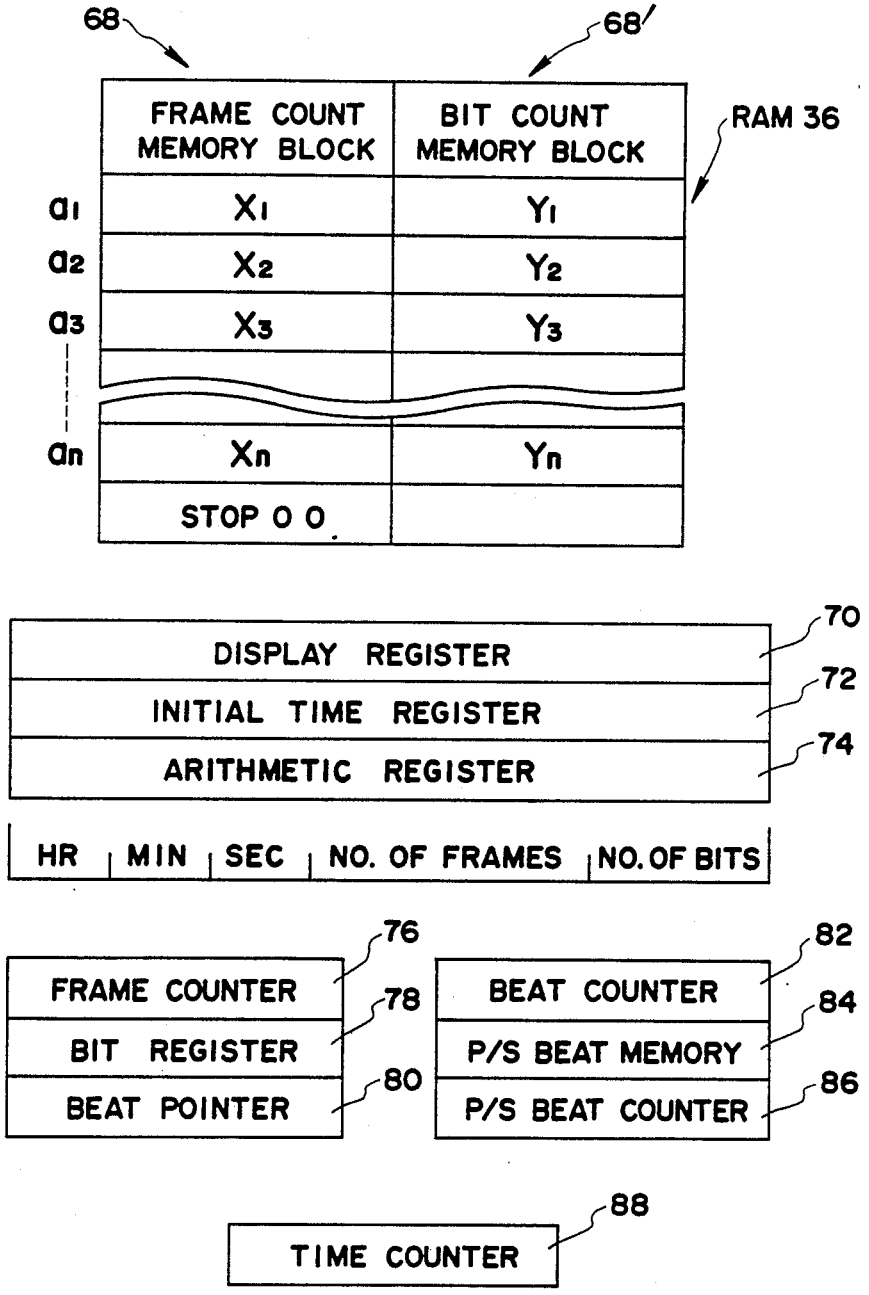
FIG. 5 includes tables showing the configuration of part of the central processing unit illustrated in FIG. 3.

FIG. 5 of the drawings shows the configurations of the central processing unit 30 and the RAM 36 which forms part of the synchronizing signal generator 14 thus constructed and arranged.

The RAM 36, which forms part of the internal memory of the synchronizing signal generator 14 shown in FIG. 1, comprises two memory blocks each of which has eight bytes at each of its addresses. One of these two memory blocks is a frame-count memory block 68 and the other is a bit-count memory block 68'. The frame-count memory 68 is used for the storage of the frame counts $X_1, X_2, X_3, \ldots X_n$ between the successive beats forming the operator's expressed tempo, and the bit-count memory 68' is used for the storage of the bit counts $Y_1, Y_2, Y_3, \ldots Y_n$ between the successive beats. Each of these bit counts represents a number of bits which are short of forming a single frame and which are thus less than 80 bits as previously noted. These pairs of the frame and bit counts $X_1, X_1; X_2, Y_2; X_3, Y_3; \ldots X_n, Y_n$ are located at addresses $a_1, a_2, a_3, \ldots a_n$, respectively, of the RAM 36.

On the other hand, the central processing unit 30 comprises registers which include a display register 70, an initial time register 72 and an arithmetic register 74. The display register 70 constitutes the internal register which has been frequently referred to as forming part of the synchronizing signal generator 14 and is activated repeatedly to successively memorize the recurrent SMPTE time code frames by accumulatively adding the clock pulses of the time code to the starting SMPTE time code read out at the beginning of the tape by the SMPTE time-code signal input circuit 50 (FIG. 3). When the bit-count section of the display register 70 counts 80th bit during a period of time intervening between every successive two beats, the content of the particular section is carried over and restores the zero state, and in turn, the content of the frame-count section of the register 70 is incremented by one. The initial time register 72 is used to memorize the starting SMPTE code frame alone from the series of SMPTE time codes extracted from the time code information reproduced from the tape. The initial time thus represented by the content of the initial time register 72 can be altered by manipulation of the initial time change switch and ten keys on the switchboard 44 (FIG. 3) when the intervening-playback mode of operation is selected by the operator as previously noted. The arithmetic register 74 is used to temporarily store each of the time code frames. The content of this arithmetic register 74 is utilized, when necessary, for performing arithmetic operation on the code frame currently memorized therein. Each of these display register 70, initial time register 72 and arithmetic register 74 consists of an hour-count section to memorize time in terms of hour, a minute-count section to memorize time in terms of minute, a second-count section to memorize time in terms of second, a frame-count section to memorize the number of SMPTE time code frames, and a bit-count section to memorize the number of bits short of a complete time code frame. The number to be memorized in the frame-counter section may be any of 0 to 29 and the number to be memorized in the bit-count section may be any of 0 to 79.

The central processing unit 30 further comprises a frame counter 76, a bit register 78 and a beat pointer 80. The frame counter 76 is activated during write-in mode of operation to memorize the frame count which is produced during a period of time intervening between every successive two beats on the tapping key being manipulated by the operator with the tape recorder 12 operating in a playback mode. The content of this counter 76 is updated each time a carry-over takes place in the bit-count section of the display register 70. The bit register 78 is activated to fetch and memorize the content of the bit section of the display register 70 each time a new beat signal is supplied to the central processing unit 30. On the other hand, the beat pointer 80 serves as an address counter and is used to designate any of the addresses $a_1, a_2, a_2, \ldots a_n$ of the frame and bit-count memory blocks 68 and 68'.

The central processing unit 30 further comprises a beat counter 82, a preliminary solo beat memory 84 and a preliminary solo beat counter 86 (respectively labelled as P/S MEMORY AND P/S COUNTER). The beat counter 82 is used to count and memorize the number of the beat signals supplied to the central processing unit 30 starting with the first beat of the operator's expressed tempo. Both of the preliminary solo beat memory 84 and the preliminary solo beat counter 86 are enabled during preliminary solo mode of operation when reproduction of the additional sound information by means of the sequencer module 16 is to be started prior to the start of reproduction of the base sound information reproduced from the tape. The preliminary solo beat memory 84 is used to memorize the number of the beats for the additional music to be reproduced by the sequencer module 16 until reproduction of the base music is initiated by the tape recorder 12. On the other hand, the preliminary solo beat counter 86 is operative to count the difference between the number of the beats thus memorized by the preliminary solo beat memory 84 and the number of the beats in the additional sound information which has been reproduced by the sequencer module 16 before the reproduction of the base sound information is started. The content of the preliminary solo beat counter 86 thus represents the number of the beats remaining in the preceding part of the additional sound information before the tape recorder 12 starts reproduction of the base sound information from the tape.

In addition to these registers, counter and pointers, there are further included a time counter 88 to memorize the time duration $T_i$ of the MIDI clock pulse as calculated during each of the time intervals intervening between successive beats.

Operation of the Embodiment

Figure 4:
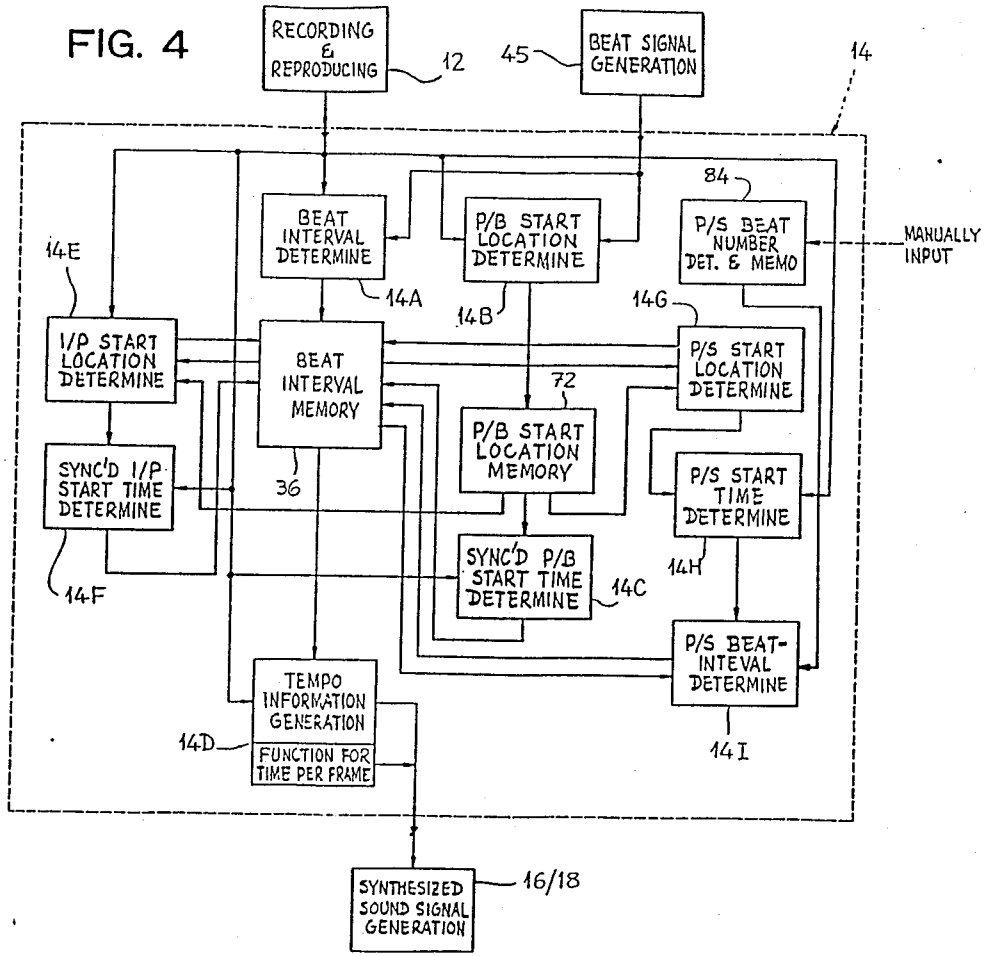
FIG. 4 is a block diagram showing the functional arrangement of the central processing unit included in the synchronizing signal generator which forms part of a synchronized sound recording and reproducing system embodying the present invention.

The functions to perform the different modes of operation as hereinbefore described are achieved under the control of the central processor unit 30 included in the synchronizing signal generator 14 which forms part of the system embodying to present invention. Thus, the central processor unit 30 has incorporated therein various functional means which are implemented by executing the program stored in the ROM 34 (FIG. 3) also included in the synchronizing signal generator 14. These functional means are operatively arranged as illustrated in FIG. 4 to accomplish the objects of the present invention as previously discussed. General aspect of the functions necessary for realizing the different modes of operation of the system will thus be first described with reference to FIGS. 1 and 3 and further to FIG. 4 prior to entering into further detailed aspects of the modes of operation.

In order to accomplish the first prime object of the present invention during the "write-in" mode of operation of a system according to the present invention, the operator of the system taps on the tapping switch on the switchboard 44 while listening to the base sound information being reproduced by the tape recorder 12 (FIG. 1) which implements information recording and reproducing means of a system according to the present invention as also indicated at 12 in FIG. 4. In response to the beats thus created by the operator's tapping actions, there are generated beat signals from beat signal generating means 45 (FIG. 4) of a system according to the present invention. While such beat signals are being generated from the beat signal generating means 45, values respectively representing the beat intervals in terms of time, viz., the time intervals between the beat signals successively output from the beat signal generating means 45 are determined by beat interval determining means 14A (FIG. 4) on the basis of the beat signals from the beat signal generating means 45 and the time code information being reproduced from the information recording and reproducing means or tape recorder 12. The time code information is synchronized with the base sound information also being reproduced from the tape recoder 12 and is provided in the form of time codes indicative of the physical locations on the recording tape which is currently in use on the tape recorder 12. In this instance, the recording tape in use provides an information recording medium in a system according to the present and the beat interval determining means also forms part of a system according to the present invention. The values determined by the beat interval determining means 14A are stored in succession into the RAM 36 which implements beat interval memorizing means of a system according to the present invention as also indicated at 36 in FIG. 4. In response to the first beat signal output from the beat signal generating means 45 (FIG. 4) and the time code present at the point of time the first beat signal is output from the means 45, playback start location determining means 14B (FIG. 4), which also forms part of a system according to the present invention, determines a value which represents that location on the tape at which the playback operation for the tape is to be started. The value thus determined by the playback start location determining means 14B is stored in playback start location memorizing means 72 (FIG. 4) which is implemented typically by an initial time register and which also forms part of a system according to the present invention.

To accomplish the first prime object of the present invention during "playback" mode of operation of a system according to the present invention, the point of time at which the playback operation synchronized with the operation of the sequencer module 16 (FIG. 1) is to be started is determined by synchronized playback start time determining means 14C (FIG. 4) which also forms part of a system according to the present invention. The synchronized playback start time determining means 14C determines such a point of time in response to the time code information reproduced from the recording and reproducing means 12 and to the value representative of the physical location of the tape as memorized in the playback start location memorizing means 72. Subsequently to such a point of time determined by the synchronized playback start time determining means 14C, MIDI clock pulses are successively generated as tempo information by tempo information generating means 14D as the values respectively representative of the time intervals between the successive beat signals are read out in succession from the beat interval memorizing means or RAM 36 (FIGS. 3 and 4). These pulses are generated on the basis of the time code information reproduced from the recording and reproducing means and of the beat interval information read from the beat interval memorizing means 36. On the basis of the time base represented by these MIDI clock pulses as the synchronizing signals, synchronized sound signals are generated by the sequencer module 16 and synthesizer module 18 (FIG. 1). In a system according to the present invention, the sequencer module 16 implements synthesized-sound signal generating means of a system according to the present invention while the synthesizer module 18 implements additional-sound synthesizing means of a system according to the present invention, as commonly indicated at 16/18 in FIG. 4. The base sound information recorded on the tape is thus reproduced by the information recording and reproducing means or tape recorder 12 at tempos exactly synchronized with the tempos of the additional sound information being synthesized by the synthesized-sound signal generating means 16/18.

In order to accomplish the second prime object of the present invention during playback mode of operation of the system, MIDI clock pulses are successively generated as the tempo information by tempo information generating means 14D on the basis of the values which are read out in succession from the beat interval memorizing means or RAM 36 (FIGS. 3 and 4) and which are respectively representative of the time intervals between the successive beat signals as discussed above. In this instance, the time durations of such MIDI clock pulses are determined depending upon a predetermined function which gives the actual period of time required for the reproduction of each frame of the time codes being reproduced by the information recording and reproducing means or tape recorder 12.

To accomplish the third prime object of the present invention during "intervening-playback" mode of operation, values respectively representative of the time intervals between the beat signals read out in succession from the the beat interval memorizing means or RAM 36 (FIGS. 3 and 4) of the system are summed up until the value resulting from the summation exceeds a value which corresponds to the time code indicative of a particular physical location on the recording tape which is in a partially wound condition, the time code being reproduced by the information recording and reproducing means or tape recorder 12. A value representing the particular physical location on the tape is thus determined by intervening-playback start location determining means 14E (FIG. 4) which also forms part of a system according to the present invention. When the value determined by the intervening-playback start location determining means 14E is equalized with the value corresponding to the time code representing the particular physical location on the tape, the point of time at which the intervening-playback mode of operation is to be started is determined by synchronized intervening-playback start time determining means 14F (FIG. 4) which also forms part of a system according to the present invention. Subsequently to the point of time thus determined, MIDI clock pulses are successively generated as the tempo information by tempo information generating means 14D on the basis of the values which are read out in succession from the beat interval memorizing means or RAM 36 (FIGS. 3 and 4) and which are respectively representative of the time intervals between the successive beat signals as discussed above.

To accomplish the fourth prime object of the present invention during preliminary solo mode of operation, a desired number of beats which should be reserved for the preliminary solo mode of operation is stored in a preliminary solo memory implementing preliminary solo beat number memory means 84 (FIG. 4) which also forms part of a system according to the present invention. A value resulting from multiplication of a value representative of the time interval allocated to the first beat signal by the preset number of beat signals memorized in the preliminary solo beat number memory means or preliminary solo memory 84 is subtracted by preliminary-solo start location determining means 14G (FIG. 4) from a value indicative of that location of the recording tape at which playback operation is to be started by the tape recorder 12. The preliminary-solo start location determining means 14G, which also forms part of a system according to the present invention, thus determines a value indicative of the location on the tape at which the preliminary solo mode of operation is to be started by the sequencer module 16. When the value indicative of that location of the recording tape at which playback operation is to be started is equalized with the value representing the time code indicative of a particular physical location on the recording tape travelling during playback operation after the sequencer module 16 has been started, the point of time at which the preliminary solo mode of operation is to be started is determined by preliminary-solo start time determining means 14H (FIG. 4) which also forms part of a system according to the present invention. The sequencer module 16 is thus permitted to start operation reproducing the sound codes which have been stored in the internal memory of the sequencer module 16. After the value representing a time code indicative of a location on the tape exceeded the value indicative of that location of the recording tape at which playback operation is to be started, the value representative of the time interval allocated to the aforesaid first beat signal is established as representing an effective preliminary-solo beat interval until the value representing a time code indicative of a location on the tape travelling is equalized with the value indicative of that location of the recording tape at which the playback operation is to be started. This is performed by preliminary-solo beat interval determining means 14I (FIG. 4) which also forms part of a system according to the present invention. Thus, the tempo information generating means 14D (FIG. 4) generates MIDI clock pulses each on the basis of the value representative of the time interval allocated to the first beat signal and a value representative of each of the time intervals between the beat signals which are read out in succession from the beat interval memorizing means or RAM 36 (FIGS. 3 and 4) subsequently to the aforesaid first beat signal.

The various functions of the system embodying the present invention as executed by the central processing unit 30 under the control of the program instructions memorized in the ROM 34 will be hereinafter in more detail described as to each of the different modes of operation of the system with concurrent reference to FIGS. 1 to 5 and further with FIGS. 5 to 11.

Figure 6:
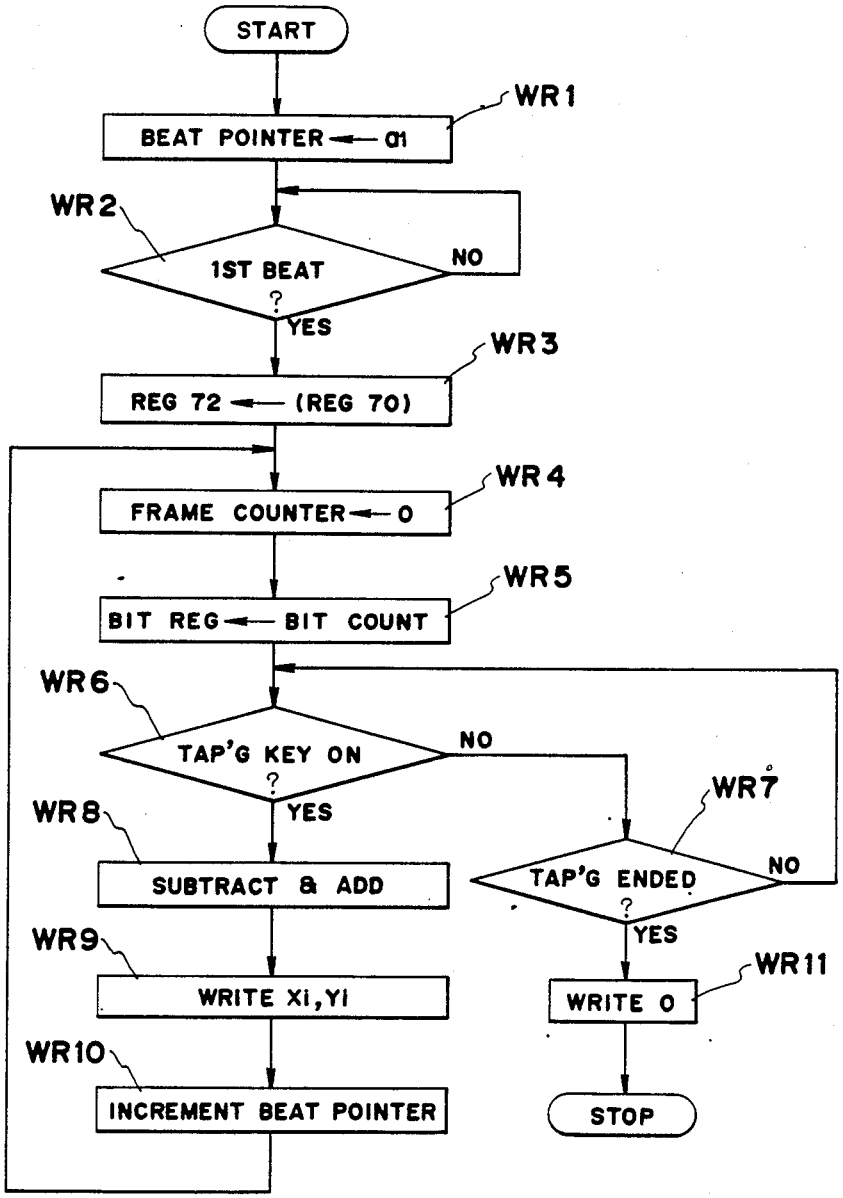
FIG. 6 is a flowchart showing the steps to execute a write-in mode of operation in the synchronized sound recording and reproducing system including the synchronizing signal generator embodying the present invention.

(1) Write-in mode of operation (FIG. 6)

During write-in mode of operation of the system the time invervals between, beat signals representative of the tempo created by the operator tapping on the tapping key on the switchboard 44 (FIG. 3) are stored into the RAM 36 of the central processing unit 30 (FIG. 3) in the form of beat interval codes. The write-in mode of operation is selected with the mode key on the switchboard 44 manipulated by the operator.

The write-in mode of operation being thus selected, the tape recorder 12 (FIG. 1) operates in a playback mode and the central processing unit 30 represents the ROM 34 to provide first the program instruction stored at the starting address and thereafter the subsequent addresses of the ROM 34 (FIG. 3). The central processing unit 30 thus reads and executes the various program instructions from ROM 34 and loads the beat pointer 80 with the address $a_1$ of the RAM 36 by step WR1 in the flowchart of FIG. 6. The central processing unit 30 then determines whether or not the first beat interval signal has been received from the tapping key by step WR2. If the result of the decision step WR2 is in the negative NO, the central processing unit 30 repeats the loop including the step WR2 until the answer in the step WR2 turns affirmative. The tape recorder 12 being in the playback mode of operation, the base sound information recorded on the sound track and, concurrently, the SMPTE time code signal recorded on the code track of the tape set on the tape recorder 12 are picked up continuously from the beginning of the sound information onward. The resultant time code signal is supplied via the signal line 22 to the synchronizing signal generator 14 (FIG. 1) or, more particularly, the SMPTE time-code signal input circuit 50 of the central processing unit 30 (FIG. 3), which thus extracts digitized time code signals from the incoming signal. These digitized time code signals are supplied through the data line 48 to the serial-to-parallel converter 38 and are memorized into the register (not shown) included in the converter 38. In response to the synchronizing word which appears at the end of the first frame of time codes, the serial-to-parallel converter 38 converts the synchronizing word into parallel bits and transmits an interrupt signal to the central processing unit 30 over the first interrupt line 54 and thereby generates the previously mentioned first interrupt in the central processing unit 30 as will be seen from sections (A) and (B) of FIG. 7. The central processing unit 30 is thus enabled to place a number "79" into the bit-count section of the display register 70 (FIG. 5) thereof. The central processing unit 30 thus interrupted for the first time after the write-in mode of operation has been commenced then starts the routine to read the codes in the subsequent second frame of the SMPTE time codes which are being loaded onto in the register of the serial-to-parallel converter 38. The time codes of the frame (except for the synchronizing word) are read from the serial-to-parallel converter 38 at the rate of the serial-to-parallel conversion rate therein, viz., at the rate of eight bits at each of eight times and are written into the hour-count, minute-count, second-count, frame-count and bit-count sections of the display register 70.

Figure 7:
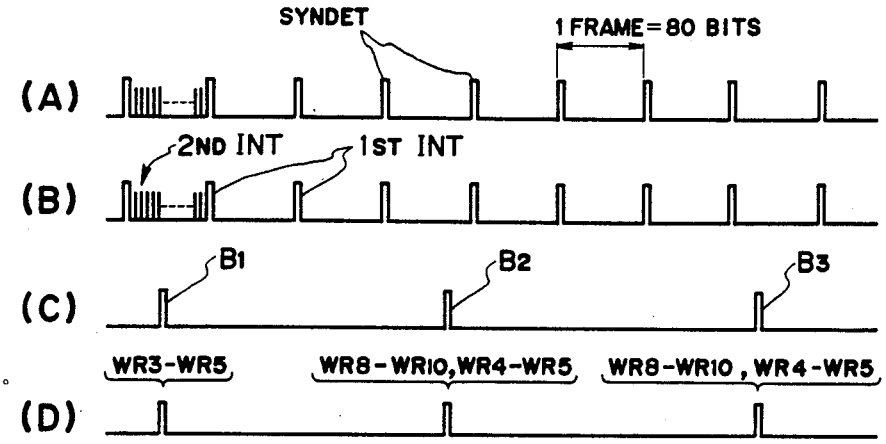
FIG. 7 is a time chart showing waveforms of pulse signals which appear during the write-in mode of operation of the system including the synchronizing signal generator which forms part of a synchronized sound recording and reproducing system embodying the present invention.

When each of the bits forming the time codes discriminated from the incoming frequency shifted signal is produced in the SMPTE time-code signal input circuit 50, an interrupt signal is supplied from the SMPTE time-code signal input circuit 50 to the central processing unit 30 via the second interrupt line 52 and thus generates the previously mentioned second interrupt in the central processing unit 30, as will be also seen from sections (A) and (B) of FIG. 7. By each of the second interrupts, the central processing unit 30 is enabled to add "1" to the bit-count section of the display register 70 which has once been loaded with the starting time code frame. Since the second interrupt is generated also immediately after the number "79" was set in the bit-count section of the display register 70 by the first interrupt as above noted, a carry-over takes place in this section of the register 70 with the result that the particular section restores the "0" state. The display register 70 is then caused to increment one by one as the individual bits of the SMPTE time code subsequent to the starting time code frame are produced successively in the SMPTE time-code signal input circuit 50.

The display register 70 is in this manner enabled to memorize a particular location of the travelling tape at every moment of the write-in mode of operation. If it happens that the SMPTE time-code signal input circuit 50 fails to produce a complete series of bits in one of the time code frames, the display register 70 will be disabled from incrementing its count-bit section properly in response to the bits forming the particular frame. Such a dropout of a bit or bits is however nullified in the subsequent frame of time codes since the content of the bit-count section of the display register 70 is forcibly shifted to "79" which substantially refers to "0" at the end of the preceding time code frame. This prevents accumulation of errors in the content of the bit-count section of the display register 70 and, accordingly, the display register 70 is permitted to precisely follow the travel of the tape even when a dropout of a bit is invited in the SMPTE time-code signal input circuit 50. When and each time the content of the bit-count section of the displey register 70 reaches 80 in number, the frame-count section of the display register 70 is incremented by one and the bit-count section of the displey register 70 is reset to zero state. Each time this takes place, "1" is added to the content of the frame counter 76.

When the operator starts tapping actions with the tapping key on the switchboard 44 (FIG. 3) while listening to the base sound information being reproduced by the tape recorder 12, beat signals $B_1$, $B_2$, $B_3$ . . . (section (C) of FIG. 7) respectively representing the individual beats on the tapping key are supplied to the central processing unit 30 each time the tapping key is depressed by the operator. The "beat" signals are indicative of the timings at which the tappink key is depressed by the operation and are distinguished from the "beat interval" codes which have been frequently mentioned as representing the time intervals between the successive beats or, now, successive "beat" signals. In response to the first beat signal $B_1$ thus supplied, the result of the decision step WR2 in the flowchart of FIG. 6 shifts to the affirmative YES so that the contents in the individual code sections of the display register 70 are transferred to the respectively corresponding code sections of the initial time register 72 by step WR3 in the flowchart of FIG. 6. The step WR3 is followed by process steps WR4 in which the frame counter 76 (FIG. 5) is reset to zero state and further by step WR5 in which the content of the bit-counter section of the display register 70 is transferred to the corresponding section of the bit register 78 (FIG. 5).

Upon completion of the steps WR3, WR4 and WR5 in response to the first beat signal $B_1$ (section (D) of FIG. 7), the central processing unit 30 determines whether or not the second beat signal $B_2$ is supplied thereto by step WR6. If the result of this decision step WR6 is in the negative NO, then the central processing unit 30 preceeds to step WR7 to determine whether the tapping complete signal (labelled as "STOP ØØ" in the frame-count memory block 68 in FIG. 5) to inform the system that the operator's tapping actions are complete is present or not. The central processing unit 30 thus recycles the loop consisting of the steps WR6 and WR7 in the flowchart of FIG. 6 while enabling the display register 70 to memorize the number of the frames which have appeared in the SMPTE time-code signal input circuit 50 after the tape recorder 12 was initiated into operation and the number of the bits short of a complete frame. The content of the display register 70 is thus a faithful representation of a particular location of the tape travelling in the tape recorder 12.

When the second beat signal $B_2$ reaches the central processing unit 30 thereafter, the result of the decision step WR6 shifts to the affirmative YES. The central processing unit 30 now subtracts the content of the bit register 78 from number 80 and adds the content of the bit-count section of the display register 70 to the result of the subtraction under the control of the instructions from the ROM 34 (FIG. 3). These operations are indicated by step WR8 in the flowchart of FIG. 6. The number of the bits indicated by the content of the bit register 78 updated by the step WR5 represents the number of the bits counted from the last frame that appeared in part before the first beat signal $B_1$ was received. Subtraction of the content of the bit register 78 from the number 80 thus gives the number of the bits remaining in the first frame that appeared in part after the first beat $B_1$ was received. Furthermore, the number of the bits indicated by the content of the bit-count section of the display counter 70 represents the number of the bits counted from the last frame that appeared in part before the second beat signal $B_2$ was received. As a consequence of the subtraction and the subsequent addition of the content of the display register 70 to the result of the subtraction, there is thus obtained the total number of the bits contained in the first and last incomplete frames which were appearing respectively when the first and second beat signals $B_1$ and $B_2$ were received. These arithmetic operations are carried out in the arithmetic and logic unit (ALU, not shown) included in the central processing unit 30. The content of the frame counter 76 and the final result of the arithmetic operations are written as a beat interval code representative of the frame and bit counts into the frame-count and bit-count memory blocks 68 and 68', respectively, of the RAM 36 (FIG. 5) at the starting address $a_1$ of the memory by step WR9 in the flowchart of FIG. 6. The beat pointer 80 is then incremented by one to memorize the second address $a_2$ of the RAM 36 by step WR10, whereupon the central processing unit 30 waits the arrival of the third beat signal $B_3$ while reverting to the steps WR4 and WR5 and recycling the loop of the decision steps WR6 and WR7.

Each time a beat signal subsequent to the first beat signal $B_1$ is received by the central processing unit 30, the steps WR4 and WR5 are executed repeatedly and the loop of the decision steps WR6 and WR7 recycled and the increments in the numbers of frames and bits increased during the time interval intervening between every successive two beat signals are written into the RAM 36 at each of the addresses $a_1$, $a_2$, $a_3$, . . . $a_n$ of the RAM 36.

When the tapping operation by the operator is complete and the tapping-complete switch on the switchboard 44 (FIG. 3) is depressed by the operator, the result of the decision step WR7 shifts to the affirmative YES. The central processing unit 30 now writes zero into the RAM 36 at the final address $a_n$ of the RAM 36 by step WR11 in the flowchart of FIG. 6, thereby putting an end to the write-in mode of operation. It may be noted that, among the various steps indicated by the flowchart in FIG. 6, the step WR1 and steps WR4 to WR11 implement the beat-interval determining means 14A in the system shown in FIG. 4 and the steps WR2 and WR3 implement the playback start location determining means 14B in the system shown in FIG. 4.

Figure 9:
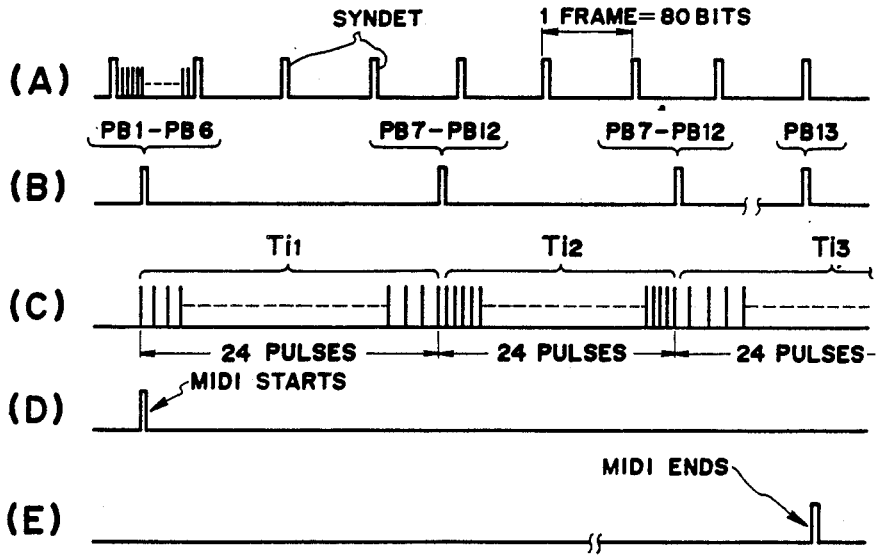
FIG. 9 is a time chart showing waveforms of pulse signals which appear during the ordinary playback mode of operation of the system including the synchronizing signal generator which forms part of a synchronized sound recording and reproducing system embodying the present invention.
Figure 8:
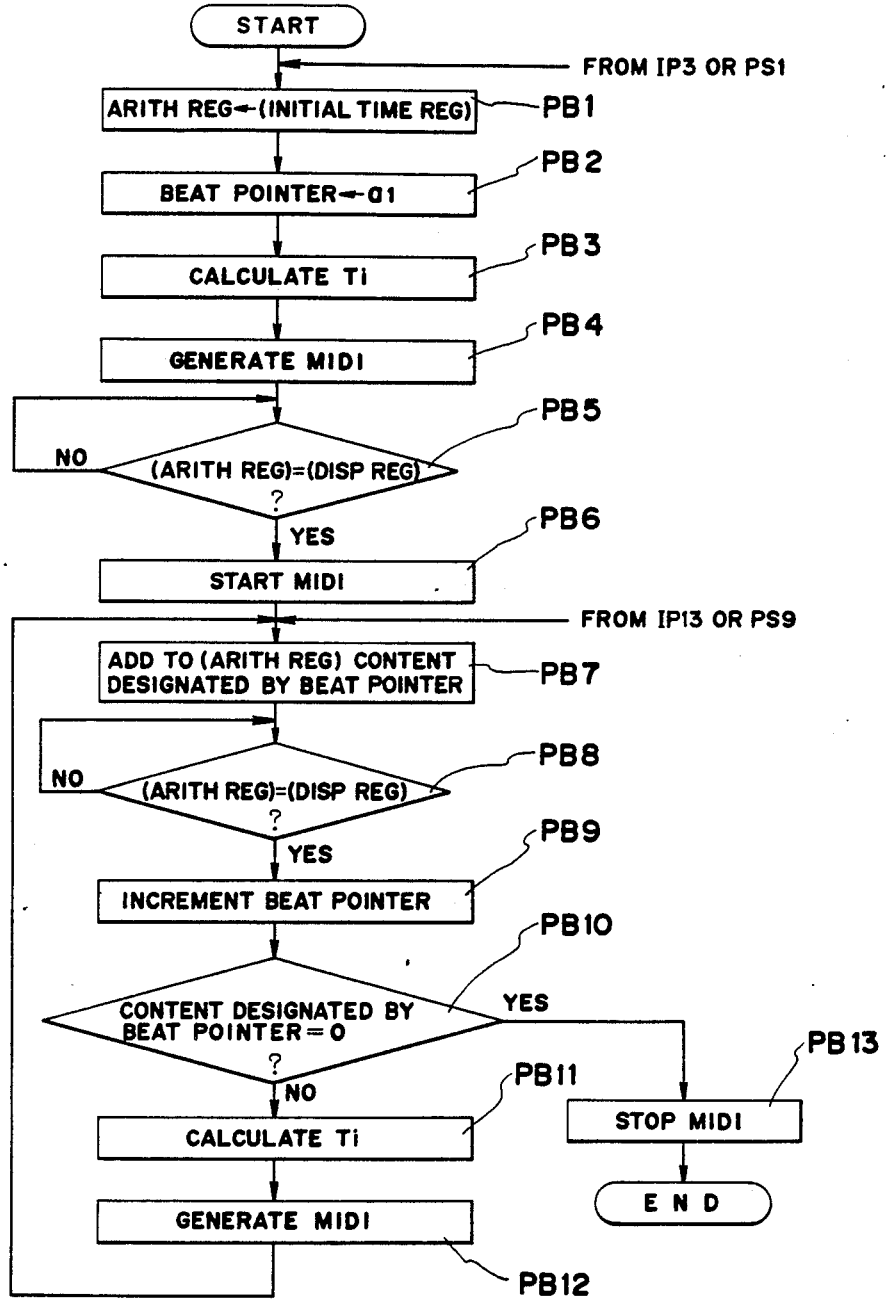
FIg. 8 is a flowchart showing the steps to execute a playback mode of operation in the synchronized sound recording and reproducing system including the synchronizing signal generator embodying the present invention.

(2) Playback mode of operation (FIGS. 8 and 9)

During playback mode of operation of the system, both the base sound information recorded on the tape set on the tape recorder 12 and the additional sound information memorized in the sequencer module 16 (FIG. 1) are played back in concert with each other with a tempo created by the operator. The playback mode of operation is also selected with the mode key on the switchboard 44 (FIG. 3) manipulated by the operator. In this instance, it is important that the tape to be played back in this mode be completely rewound before the mode key is to be depressed.

The playback mode of operation being thus selected, the tape recorder 12 (FIG. 1) operates also in a playback mode and the central processing unit 30 reads the SMPTE time codes in the starting frame extracted by the SMPTE time-code signal input circuit 50 and loads these time codes into the display register 70. Thereafter, the central processing unit 30 increments the bit-count section of the display register 70 successively as the tape travels and the bits forming the digitized time code signals produced in the SMPTE time-code signal input circuit 50 arrive at the central processing unit 30 by way of the serial-to-parallel converter 38. The central processing unit 30 further transfers the content of the initial time register 72 to the arithmetic register 74 by step PB1 in the flowchart of FIG. 8. The central processing unit 30 then designates the starting address $a_1$ of the RAM 36 (FIG. 5) in the beat pointer 80 by step PB2. All these steps followed by the central processing unit 30 are performed under the control of the program instructions from the ROM 34 (FIG. 3).

Thereafter, the central processing unit 30 accesses the starting address $a_1$ of the RAM 36 (FIG. 5), reads the frame count $X_1$ and bit count $Y_1$ from the particular address, and calculates the time duration $T_{i1}$ of an MIDI clock pulse (FIG. 9) in accordance with the formula (2) by step PB3. The time interval $T_{i1}$ thus obtained is set into the time counter 88 and the central processing unit 30 successively supplies its internal clock pulses each of 1 microsecond cycle the time counter 88. When the time duration represented by the count of the time counter 88 is equalized with the time duration $T_{i1}$ of the MIDI clock pulse calculated as discussed above, the time counter 88 generates an internal interruption therein to start generation of each of MIDI clock pulses by step PB4 and is then reset.

The central processing unit 30 now determines by step PB5 whether or not the content of the display register 70 reaches the time codes which have already been memorized in the arithmetic register 74 by step PB5. If the result of this decision step PB5 is in the negative NO, the central processing unit 30 waits and repeats the loop of the step PB5. When the result of the step PB5 is shifted to the affirmative YES with the time codes of the currently occurring frame of the tape coinciding with the memorized initial time, an instruction signal to deliver the MIDI clock pulses is issued from the central processing unit 30 by step PB6 in the flowchart of FIG. 8 with the result that the MIDI clock pulse output circuit 56 (FIG. 3) is enabled to supply the sequencer module 16 with twenty four of the MIDI clock pulses each with the time duration $T_{i1}$ of which has been calculated by the step PB3. In response these MIDI clock pulses, the sequencer module 16 reads the additional sound information preliminarily programmed in the internal memory thereof and enables the synthesizer 18 to generate audio signals. The synthesizer module 18 now produces the synthesized version of the additional sound information which is thus reproduced through the sound generator unit 20 so that synchronized playback of the base sound information recorded on the tape and the additional sound information from the sound generator unit 20 is started.

Subsequently, the central processing unit 30 accesses the starting address $a_1$ of the RAM 36 as designated by the beat pointer 80 and reads the frame count $X_1$ and bit count $Y_1$ therefrom and adds these counts to the contents of the frame-count and bit-count sections, respectively, of the arithmetic register 74 by step PB7. The central processing unit 30 then determines whether or not the content of the display register 70 is identical with the content of the arithmetic register 74 by decision step PB8. While the result of this decision step PB8 remains in the negative NO meaning that the number of the MIDI clock pulses generated by the step PB4 is still short of twenty four, the MIDI clock pulse output circuit 56 continues delivery of the MIDI clock pulses each of the time duration $T_{i1}$ under the control of the central processing unit 30. When the location of the tape at which the second beat of the base sound information is to be reproduced reaches the playback head of the tape recorder 12 and as a consequence the content of the display register 70 is equalized with the content of the arithmetic register 74, the result of the decision step PB8 turns to the affirmative YES with a total of twenty four MIDI clock pulses supplied to the sequencer module 16. The central processing unit 30 then increments the beat pointer 80 to the address $a_2$ by step PB9 in the flowchart of FIG. 8 and, in step PB10, accesses the particular address of the RAM 36 to see if the content of the particular address $a_2$ is indicative of zero state, viz., whether or not there is no beat signal remaining in the additional sound information to be reproduced. While there are remaining beat signals, the result of the decision step PB10 remains in the negative NO so that the central processing unit 30 reads the frame count $X_2$ and bit count $Y_2$ from the address $a_2$ of the RAM 36 as designated by the beat pointer 80 and calculates the time duration $T_{i2}$ of an MIDI clock pulse on the basis of these parameters by step PB11. The central processing unit 30 thus generates in step PB12 in the flowchart of FIG. 6 the MIDI clock pulses each with the time duration $T_{i2}$ thus obtained, by following the same procedures as those taken in the step PB4. A total of twenty four of such MIDI clock pulses are thus supplied in succession from the MIDI clock pulse output circuit 56 of the synchronizing signal generator 14 to the sequencer module 16.

The central processing unit 30 thereafter recycles loop of the steps PB7 to step PB12 in the flowchart of FIG. 8 and generates successive series of MIDI clock pulses with time durations $T_{i3}$, $T_{i4}$, . . . while incrementing the beat pointer 80 from the address $a_2$ to the address $a_3$, from the address $a_3$ to the address $a_4$ and so on. When the result of the decision step PB10, viz., all of the frame counts $X_1$, $X_2$, $X_3$, . . . $X_n$ and bit counts $Y_1$, $Y_2$, $Y_3$, . . . $Y_n$ memorized in the RAM 36 are read out, the central processing unit 30 reads the tapping complete signal STOP ØØ (FIG. 5) in the RAM 36 and issues an instruction signal to terminate generation of MIDI clock pulses by step PB13, thereby putting an end to the playback mode of operation. It may be noted that, among the various steps indicated by the flowchart of FIG. 8, the steps PB1 and PB5 implement the synchronized playback start time determining means 14C in the system shown in FIG. 4 and the steps PB2 to PB4 and steps PB6 to PB13 implement part of the tempo information generating means 14D in the system shown in FIG. 4.

Figure 10:
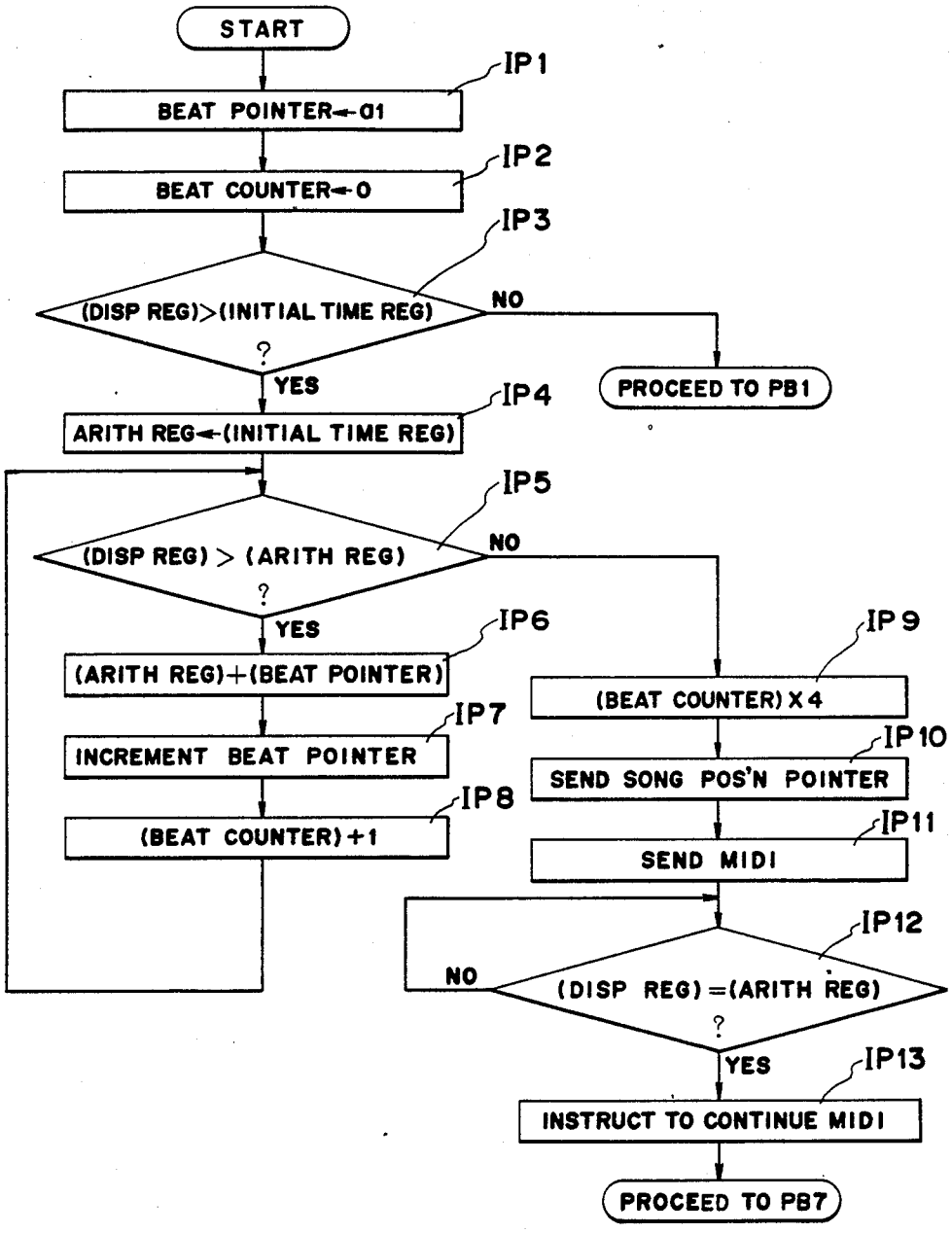
FIG. 10 is a flowchart showing the steps to execute an intervening-playback mode of operation in the synchronized sound recording and reproducing system including the synchronizing signal generator which forms part of a synchronized sound recording and reproducing system embodying the present invention.

(3) Intervening-playback mode of operation (FIG. 10)

The intervening-playback mode of operation of the system according to the present invention is used for the playback of a tape which is in a partially rewound condition. This intervening-playback mode of operation is also selected with the mode key on the switchboard 44 (FIG. 3) manipulated by the operator.

The intervening-playback mode of operation being thus selected, the tape recorder 12 (FIG. 1) operates in a playback mode and the central processing unit 30 reads from the SMPTE time-code signal input circuit 50 (FIG. 3) the SMPTE time codes of the frame which first occurs after the tape has been driven to travel. The central processing unit 30 loads the SMPTE time codes in the particular frame into the display register 70 and thereafter increments the bit-count section of the display register 70 successively as the bits forming the digitized time code signals produced in the SMPTE time-code signal input circuit 50 arrive at the central processing unit 30. Thereupon, the central processing unit 30 designates the starting address $a_1$ by means of the beat point 80 as by step IP1 in the flowchart of FIG. 10 and resets the beat counter 82 to the "zero" state thereof as by step IP2. The central processing unit 30 then proceeds to decision step IP3 to determines whether or not the value currently stored by the display register 70 is larger than the value indicative of the initial time stored in the initial time register 72 or, in other words, whether the current location of the tape is forward of the location at which the intermediate playback operation is to be started. If the answer in the decision step IP3 is given in the negative "NO" meaning that the tape must be further rewound before the start of playback operation, the system proceeds to the ordinary playback mode of operation described with reference to FIG. 8. Otherwise it will be found that the current location of the tape is forward of the location at which the intermediate playback operation is to be started so that the answer in the decision step IP3 is given in the affirmative "YES". The central processing unit 30 further transfers the content of the initial time register 72 to the arithmetic register 74 by step IP4 in the flowchart of FIG. 10 and thereupon determines whether or not the time represented by the content of the display register 70 is later than the time represented by content of the arithmetic register 74, viz., than the initial time by step IP5. If, in this instance, the current position of the tape on the tape recorder 12 is anterior to the position of the tape represented by the sums of the frame and bit counts represented by the initial time codes and the frame and bit counts of the RAM 36 at the address designated by the beat pointer 80 and if the result of the decision step IP5 is in the affirmative YES, the central processing unit 30 reads the frame count $X_1$ and bit count $Y_1$ from the RAM 36 at the address $a_1$ designated by the beat pointer 80 and add these counts to the contents of the frame-count and bit-count sections, respectively, of the arithmetic register 74 by step IP6. The central processing unit 30 thereafter increments the beat pointer 80 by step IP7, adds "1" to the beat counter 82 by IP8, and repeats the decision step IP5. While comparing the content of the display register 70 with the content of the arithmetic register 74 (step IP5) and rapidly increments the beat pointer 80 successively (step IP7), the central processing unit 30 stepwise adds the frame counts $X_1$, $X_2$, $X_3$, . . . $X_n$ and bit counts $Y_1$, $Y_2$, $Y_3$, . . . $Y_n$ of the RAM 36 at the addresses $a_1$, $a_2$, $a_3$, . . . $a_n$ respectively, designated by the beat pointer 80 to the contents of the frame-count and beat-count sections, respectively, of the arithmetic register 74. The contents of these count sections of the arithmetic register 74 are, in the result, increased beyond the corresponding sections of the display register 70 so that the result of the decision step IP5 turns negative. When this takes place, the content of the beat counter 82 is multiplied by four to calculate the MIDI song position pointer by step IP9 in the flowchart of FIG. 10. The number of the MIDI beats intervening between the initial time and the time when the content of the arithmetic register 74 exceeded the content of the display register 70 can be obtained by this multiplication since the number of the beats produced by the time the content of the arithmetic register 74 "overran" the content of the display register 70 is memorized in the beat counter 82. Here, it is noted that the time duration of one beat represented by a quarter note is defined as the sum of four MIDI beats as previously explained. The MIDI song position pointer expressed by the number of such MIDI beats is transmitted from the MIDI clock pulse output circuit 56 (FIG. 3) of the synchronizing signal generator 14 to the sequencer module 16 under the control of the central processing unit 30 by step IP10 in the flowchart of FIG. 10. The sequencer module 6 which has received this MIDI song position pointer designates the address represented by this pointer and waits thereafter.

On the other hand, the central processing unit 30 calculates the time duration $T_i$ of an MIDI clock pulse on the basis of the frame and bit counts $X_i$ and $Y_i$ read from the RAM 36 at the address designated by the beat pointer 80 as in the course of the ordinary playback mode of operation, thereby generating a series of MIDI clock pulses each having the time duration $T_i$ thus calculated (step IP11). In the meantime, the tape on the tape recorder 12 continues travelling and accordingly the content of the display register 70 increases successively. The central processing unit 30 determines whether or not the content of the display register 70 thus increased is equalized with the content of the arithmetic register 74 by step IP12 in the flowchart of FIG. 10. The central processing unit 30 waits while the content of the arithmetic register 74 remains in excess of the content of the display register 70 but is supplying an instruction signal MIDI CONTINUE to the sequencer module 16 by step IP13 at the very moment when the former is on the point of being overrun by the latter for a second time with the result of the decision step IP12 turned to the affirmative YES. In response to this instruction signal MIDI CONTINUE, the sequencer module 16 reads sound signals as the additional sound information at the addresses starting with the address designated by the MIDI song position pointer in synchronism with the tempo expressed by the time duratonss of the MIDI clock pulses. These sound signals are fed to the synthesizer module 18, which thus synthesize the additional music from the signals received. After synchronized reproduction of the base and additional sound information is started in this manner, the central processing unit 30 proceeds to the step PB7 of the ordinary playback mode of operation and subsequently follows the steps PB8 to PB13 in the flowchart of FIG. 8.

It may be noted that the content of the arithmetic register 74 may be so determined that the synchronizing signal generator 14 is to send out the above mentioned "MIDI CONTINUE" to the sequencer module 16 at a timing which is several beats later than the point of time at which the content of the display register 70 was overrun by the content of the register 74, viz., when the MIDI song position pointer was sent out. This is because of the fact that the sequencer module 16 may be disabled from promptly responding to the instruction signal "MIDI CONTINUE" if this signal is received immediately after the MIDI song position pointer reached the sequencer module 16.

The intervening-playback mode of operation of the system may be performed in a slightly modified fashion if desired by the operator. For this purpose, the operator revises a portion of the additional sound information already programmed in the sequencer module 16 to partly modify the additional sound information to be reproduced. The operator then plays back the modified portion alone of the additional sound information in an attempt to evaluate the effect of the synchronized performance of the modified portion of the additional sound information and the corresponding portion of the base sound information reproduced from the tape. The operator is thus enabled to cause the system to execute the synchronized playback upon confirmation of the precise region of such a modified portion of the addition sound information. In this instance, the operator can request the system to change the initial time memorized in the synchronizing signal generator 14. The numbers to inidicate the desired new initial time can be loaded into the system with use of the "ten" keys on the switchboard 44 (FIG. 3).

It may be further noted that, among the various steps indicated by the flowchart of FIG. 10, the step IP1 and steps the step IP1 and steps IP4 to IP7 implement the synchronized intervening-playback start location determining means 14E in the system shown in FIG. 4, the steps IP12 and IP13 implement the synchronized intervening-playback start time determining means 14F in the system shown in FIG. 4, and the steps IP2 and IP8 and steps IP9 to IP11 implement part of the tempo information generating means 14D in the system shown in FIG. 4.

Figure 11:
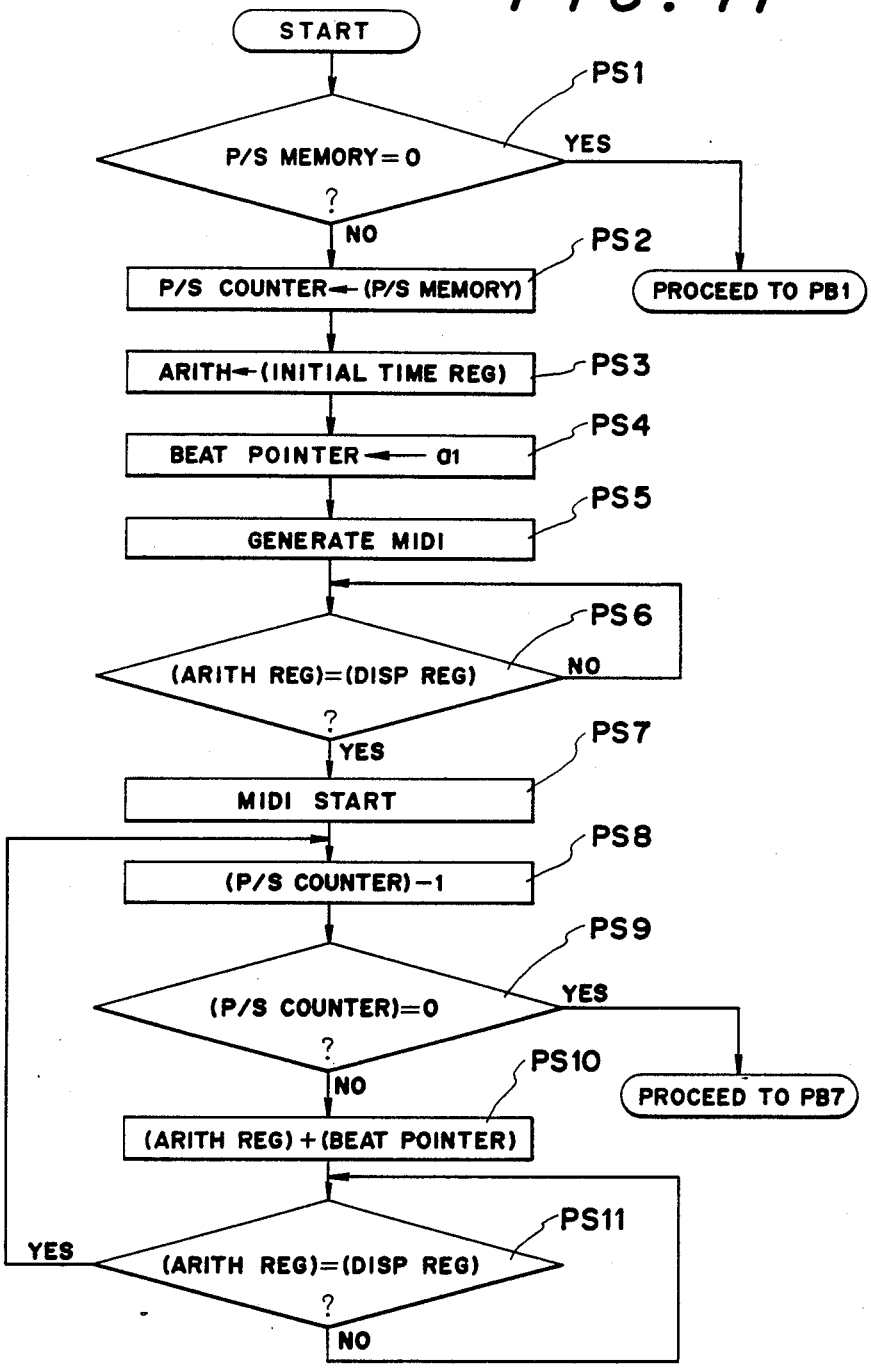
FIG. 11 is a flowchart showing the steps to execute a preliminary solo mode of operation in the synchronized sound recording and reproducing system including the synchronizing signal generator which forms part of a synchronized sound recording and reproducing system embodying the present invention.

Preliminary-solo mode of operation (FIG. 11)

To operate the system in the preliminary solo mode, the operator must first manipulate the preliminary solo mode request switch on the switchboard 44 (FIG. 3) to make the preliminary solo beat memory 84 (FIG. 5) of the central processing unit 30 ready to accept the operator's desired number of beats (hereinafter referred to as preliminary solo beats) to be allocated to the particular mode of operation. The desired number of preliminary solo beats can be loaded into the system with use of the "ten" keys on the switchboard 44.

The preliminary solo beats being thus memorized into the preliminary solo beat memory 84, the central processing unit 30 of the synchronizing signal generator 14 multiplies the content of the preliminary solo beat memory 84 by the frame count $X_1$ and bit count $Y_1$ memorized at the starting address $a_1$ of the RAM 36. The results of the multiplication are subtracted from the contents of the frame-count and bit-count sections, respectively, of the initial time register 72, and the final results of the arithmetic operations are memorized as updated contents into these sections of the initial time register 72. The content of the initial time register 72 now indicates the location of the tape which is posterior by the time for the number of the memorized preliminary solo beats to the time representative of the location of the tape at which the first beat was memorized during write-in mode of operation.

After the preliminary solo mode of operation is started, the central processing unit 30 first determines whether or not the content of the preliminary solo beat memory 84 is of the zero state by step PS1 in the flowchart of FIG. 11. If the result of this decision step PS1 is in the affirmative YES, the central processing unit 30 proceeds to the ordinary playback mode of operation described with reference to FIG. 8. If, however, the answer to the step PS1 is in the negative NO with a certain number of preliminary solo beats memorized in the preliminary solo beat memory 84, the central processing unit 30 transfers the content of the memory 84 to the preliminary solo beat counter 86 by step PS2 and transfers the content of the initial time register 72 to the arithmetic register 74 by step PS3 in the flowchart of FIG. 11. The step PS3 is followed by step PS4 by which the central processing unit 30 designates in the best pointer 80 the starting address $a_1$ of the RAM 36 at which the frame count $X_1$ and bit count $Y_1$ are memorized. Then the central processing unit 30 accesses the address $a_1$ of the RAM 36 to read these frame and bit counts $X_1$ and $Y_1$ and generates MIDI clock pulses each having the time duration $T_{i1}$ calculated in accordance with the previously presented formula (2) by step PS5.

As soon as the preliminary solo mode of operation is started, the SMPTE time codes of the frame recorded on the tape recorder 12 are read by the display register 70 from the SMPTE time-code signal input circuit 50 (FIG. 3) and the content of the display register 70 is incremented bit by bit as the tape travels in the tape recorder 12. The central processing unit 30 thus determines whether or not the revised initial time represented by the content of the arithmetic register is in agreement with the current content of the display register 70 by step PS6 in the flowchart of FIG. 11. If the result of this decision step PS6 is in the negative NO, the central processing unit 30 waits. When the tape on the tape recorder 12 thereafter reaches the position to start the preliminary solo playback operation, the content of the display register 70 catches up with the content of the arithmetic register 74 so that the result of the decision step PS6 shifts to the affirmative YES. The central processing unit 30 now loads the sequencer module 16 with an "MIDI START" signal and the MIDI clock pulses from the MIDI clock pulse output circuit 56 by step PS7. In response to these "MIDI START" signal and MIDI clock pulses, the sequencer module 16 produces sound signals on the basis of the additional sound information programmed in the internal memory thereof and the tempo expressed by the MIDI clock pulses before the base sound information is reproduced by the tape recorder 12. These sound signals are fed to the synthesizer module 18. The synthesized additional sound information is thus produced from the sound generator unit 20 at a timing which is anterior by the number of the memorized preliminary solo beats to the start of reproduction of the base sound information from the tape.

The central processing unit 30 which has generated the MIDI start signal subtracts 1 from the preliminary solo beat counter 86 by step PS8, which is followed by decision step PS9 by which the central processing unit 30 determines whether or not the content of the preliminary solo beat counter 86 is reduced to 0. If the system is still in the course of operating in the preliminary solo mode, the result of this decision step PS9 will be in the negative NO. In this instance, the frame count $X_1$ and the bit count $Y_1$ memorized in the RAM 36 at the address $a_1$ designated by the beat pointer 80 are added to the contents of the frame-count and bit-count sections of the arithmetic register 74 memorizing the revised initial time. The central processing unit 30 then determines whether or not the resultant content of the arithmetic register 74 conforms to the content of the display register 70 by decision step PS11 in the flowchart of FIG. 11. While the result of this decision step PS11 is in the negative NO, the central processing unit 30 waits until the content of the display register 70 which is successively incremented as the tape travels catches up with the content of the arithmetic register 74. After the result of the decision step PS11 is thus turned affirmative YES, the central processing unit 30 recycles the loop consisting of the steps PS8, PS9, PS10 and PS11 until the result of the decision step PS9 shifts to the affirmative YES.

When the tape then reaches the position represented by the initial time and the preliminary solo mode of operation is complete, the result of the decision step PS9 is turned to the affirmative YES, the central processing unit 30 shifts to the step PB7 of the ordinary playback mode of operation as shown in FIG. 8, thereby putting an end to the preliminary solo mode of operation. Synchronized reproduction of the base sound information from the tape and the additional sound information which is continuedly reproduced by the sequencer module 16 is now started.

By performing the preliminary solo mode of operation as hereinbefore described, the operator is thus permitted to reproduce the sound information from the sequencer module 16 prior to the start of the synchronized reproduction of the base sound information from the tape and the additional sound information from the sequencer module 16. Throughout the preliminary solo mode of operation, the additional sound information programmed in the sequencer module 16 can be in this manner reproduced at a tempo to be concordant with the tempo specified by the first and second beats of the base sound information which is to be reproduced.

The step PS3 implements the preliminary-solo start location determining means 14G in the system shown in FIG. 4, the step PS6 implements the preliminary-solo start time determining means 14H in the system shown in FIG. 4, the steps PS1, PS2 and PS4 and steps PS8 to PS11 implement the preliminary-solo beat interval determining means 14I in the system shown in FIG. 4, and the steps PS5 implements part of the tempo information generating means 14D in the system shown in FIG. 4.

What is claimed is:

1. A synchronized sound recording and reproducing system including (a) sound information recording and reproducing means for recording base sound information and time code information on a recording medium and reproducing the base sound information therefrom, said recording medium being movable with respect to said sound information recording and reproducing means, said time code information being representative of different physical locations on said recording medium, said locations being arranged in the direction of movement of the recording medium, said sound information recording and reproducing means being operative to reproduce said time code information substantially in synchronism with said base sound information, (b) base sound generating means for generating base sounds on the basis of the base sound information reproduced by said sound information recording and reproducing means, (c) beat signal generating means for generating a beat signal each time the beat signal generating means is actuated, (d) synthesized-sound signal generating means operative to have additional sound information memorized therein and to reproduce the stored additional sound information in accordance with a time base expressed by synchronizing signals providing tempo information, and (e) additional-sound synthesizing means for synthesizing and generating additional sounds on the basis of the additional sound information reproduced by said synthesized-sound signal generating means, comprising in combination (A) beat interval determining means for determining beat intervals on the basis of the time code information reproduced by said sound information recording and reproducing means and the beat signals generated by said beat signal generating means (B) beat interval memorizing means for storing values respectively representative of the beat intervals determined by said beat interval determining means and allowing the stored values to be successively read out therefrom when required, (C) playback start location determining means for determining a particular physical location on said recording medium as the location at which playback operation is to be started by said sound information recording and reproducing means, said particular physical location corresponding to the first one of the best signals produced by said beat signal generating means, said playback start location determining means determining said particular physical location in response to said first one of the beat signals and to said time code information reproduced by said sound information recording and reproducing means, (D) playback start location memorizing means for memorizing a value representative of said particular physical location of said recording medium, (E) synchronized playback start time determining means for determining the point of time at which synchronized playback operation is to be started simultaneously by said sound information recording and reproducing means and said synthesized-sound signal generating said additional-sound synthesizing means, said synchronized playback start time determining means determining said point of time when a value representative of a physical location on said recording medium indicated by said time code information reproduced by said sound information recording and reproducing means is substantially equalized with said value representative of said particular physical location memorized by said playback start location memorizing means, and (F) tempo information generating means which is to become active at said point of time for generating tempo information on the basis of the values successively read out from said beat interval memorizing means and supplying the tempo information as synchronizing signals to said synthesized-sound signal generating means to enable the synthesized-sound signal generating means to reproduce said additional sound information and said additional-sound synthesizing means to generate said additional sounds in synchronism with the base sounds generated by said base sound generating means.

2. A synchronized sound recording and reproducing system as set forth in claim 1, in which said time code information reproduced by said information recording and reproducing means contains a series of frames each containing a series of time codes, said tempo information generating means being active to generate said tempo information such that the tempo information consists of a series of signals each having a time duration determined depending upon a predetermined function which is dictated by the actual period of time required for the reproduction of each frame of the time codes in the time code information reproduced by said information recording and reproducing means.

3. A synchronized sound recording and reproducing system including (a) sound information recording and reproducing means for receording base sound information and time code information on a recording medium and reproducing the base sound information therefrom, said recording medium being movable with respect to said sound information recording and reproducing means, said time code information being representative of different physical locations on said recording medium, said locations being arranged in the direction of movement of the recording medium, said sound information recording and reproducing means being operative to reproduce said time code information substantially in synchronism with said base sound information, (b) base sound generating means for generating base sounds on the basis of the base sound information reproduced by said sound information recording and reproducing means, (c) beat signal generating means for generating a beat signal each time the beat signal generating means is actuated, (d) synthesized-sound signal generating means operative to have additional sound information memorized therein and to reproduce the stored additional sound information in accordance with a time base expressed by synchronizing signals providing tempo information, and (e) additional-sound synthesizing means for synthesizing and generating additional sounds on the basis of the additional sound information reproduced by said synthesized-sound signal generating means, comprising in combination (A) beat interval determining means for determining beat intervals on the basis of the time code information reproduced by said sound information recording and reproducing means and the beat signals generated by said beat signal generating means (B) beat interval memorizing means for storing values respectively representative of the beat intervals determined by said beat interval determining means and allowing the stored values to be successively read out therefrom when required, (C) playback start location determining means for determining a first particular physical location on said recording medium as the location at which playback operation is to be started by said sound information recording and reproducing means, said first particular physical location corresponding to the first one of the beat signals produced by said beat signal generating means, said playback start location determining means determining said first particular physical location in response to said first one of the beat signals and to said time code information reproduced by said sound information recording and reproducing means, (D) playback start location memorizing means for memorizing a value representative of said first particular physical location of said recording medium, (E) intervening-playback start location determining means for summing values respectively representative of the beat intervals between the beat signals read out in succession from said beat interval memorizing means until the value resulting from the summation exceeds a value which corresponds to the time code information which is reproduced by the information recording and reproducing means and which is indicative of a second particular physical location on said recording medium, the intervening-playback start location determining means determining, on the basis of said value resulting from the summation, a value representing said particular physical location on the tape, said second particular physical location being spaced apart from said first particular physical location forwardly in the direction of movement of said recording medium with respect to said recording and reproducing means, (F) synchronized intervening-playback start time determining means for determining the point of time at which synchronized playback operation is to be started by said sound information recording and reproducing means and said additional-sound synthesizing means, said synchronized intervening-playback start time determining means determining said point of time when a value representative of said second particular physical location on said recording medium as indicated by said time code information reproduced by said sound information recording and reproducing means is substantially equalized with said value representative of said first particular physical location memorized by said playback start location memorizing means, and (G) tempo information generating means which is to become active at said point of time for generating tempo information on the basis of the values successively read out from said beat interval memorizing means and supplying the tempo information as said synchronizing signals to said synthesized-sound signal generating means to enable the synthesized-sound signal generating means to reproduce said additional sound information and said additional-sound synthesizing means to generate said additional sounds in synchronism with the base sounds generated by said base sound generating means.

4. A synchronized sound recording and reproducing system as set forth in claim 3, in which said time code information reproduced by said information recording and reproducing means contains a series of frames each containing a series of time codes, said tempo information generating means being active to generate said tempo information such that the tempo information consists of a series of signals each having a time duration determined depending upon a predetermined function which is dictated by the actual period of time required for the reproduction of each frame of the time codes in the time code information reproduced by said information recording and reproducing means.

5. A synchronized sound recording and reproducing system including (a) sound information recording and reproducing means for recording base sound information and time code information on a recording medium and reproducing the base sound information therefrom, said recording medium being movable with respect to said sound information recording and reproducing means, said time code information being representative of different physical locations on said recording medium, said locations being arranged in the direction of movement of the recording medium, said sound information recording and reproducing means being operative to reproduce said time code information substantially in synchronism with said base sound information, (b) base sound generating means for generating base sounds on the basis of the base sound information reproduced by said sound information recording and reproducing means, (c) beat signal generating means for generating a beat signal each time the beat signal generating means is actuated, (d) synthesized-sound signal generating means operative to have additional sound information memorized therein and to reproduce the stored additional sound information in accordance with a time base expressed by synchronizing signals providing tempo information, and (e) additional-sound synthesizing means for synthesizing and generating additional sounds on the basis of the additional sound information reproduced by said synthesized-sound signal generating means, comprising in combination (A) beat interval determining means for determining beat intervals on the basis of the time code information reproduced by said sound information recording and reproducing means and the beat signals generated by said beat signal generating means, (B) beat interval memorizing means for storing values respectively representative of the beat intervals determined by said beat interval determining means and allowing the stored values to be successively read out therefrom when required, (C) playback start location determining means for determining a particular physical location on said recording medium as the location at which playback operation is to be started by said sound information recording and reproducing means, said particular physical location corresponding to the first one of the beat signals produced by said beat signal generating means, said playback start location determining means determining said particular physical location in response to said first one of the beat signals and to said time code information reproduced by said sound information recording and reproducing means, (D) playback start location memorizing means for memorizing a value representative of said particular physical location of said recording medium, (E) preliminary solo beat number memory means for memorizing a preset number of beats to be reserved for preliminary solo mode of operation to be performed by said synthesized-sound signal generating means and said additional-sound synthesizing means, (F) preliminary-solo start location determining means for subtracting from a value representative of said particular physical location at which the playback operation is to be started a value resulting from multiplication of a value representative of the time interval between the first two of said beat signals by said preset number of beat signals memorized in said preliminary solo beat number memory means, said preliminary-solo start location determining means determining, as a result of the subtraction, a value indicative of the location on the recording medium at which the preliminary solo mode of operation is to be started by said synthesized-sound signal generating means, (G) preliminary-solo start time determining means for determining the point of time at which the preliminary solo mode of operation is to be started by said synthesized-sound signal generating means and said additional-sound synthesizing means, the preliminary-solo start time determining means determining said point of time when the value determined by said preliminary-solo start location determining means as being indicative of the location on the recording medium at which the preliminary solo mode of operation is to be started is substantially equalized with the value representing the time code indicative of said particular physical location on said recording medium, (H) preliminary-solo beat interval determining means for determining, as representing an effective preliminary-solo beat interval, a value representative of the time interval between the first two of said beat signals as each of the beat signals is generated by said beat signal generating means during a period of time intervening between the time when the value representing a time code indicative of a location on the tape exceeds the value indicative of said particular physical location of the recording tape at which the preliminary solo mode of operation is to be started and the time when the value representing a time code indicative of a location on the tape is substantially equalized with the value indicative of said particular physical location at which the playback operation is to be started, and (I) tempo information generating means which is to become active at said point of time at which the preliminary solo mode of operation is to be started, the tempo information generating means being active to generate tempo information on the basis of the values determined as the effective preliminary-solo beat interval by said preliminary-solo beat interval determining means the values successively read out from said beat interval memorizing means, said tempo information generating means being further active to supply the tempo information as said synchronizing signals to said synthesized-sound signal generating means to enable the synthesized-sound signal generating means to reproduce said additional sound information and said additional-sound synthesizing means to generate said additional sounds in synchronism with the base sounds generated by said base sound generating means.

6. A synchronized sound recording and reproducing system as set forth in claim 5, in which said time code information reproduced by said information recording and reproducing means contains a series of frames each containing a series of time codes, said tempo information generating means being active to generate said tempo information such that the tempo information consists of a series of signals each having a time duration determined depending upon a predetermined function which is dictated by the actual period of time required for the reproduction of each frame of the time codes in the time code information reproduced by said information recording and reproducing means.

* * * * *